US010190248B2

(12) United States Patent
Rhode

(10) Patent No.: US 10,190,248 B2
(45) Date of Patent: Jan. 29, 2019

(54) SYSTEM FOR MONITORING RESTORATION QUALITY TO A THIRD PARTY CERTIFIED STANDARD OF SOFT OBJECTS BEING WASHED REMOTELY

(71) Applicant: ESPORTA WASH SYSTEMS INC., Kelowna (CA)

(72) Inventor: Randall J. Rhode, Kelowna (CA)

( * ) Notice: Subject to any disclaimer, the term of this patent is extended or adjusted under 35 U.S.C. 154(b) by 531 days.

(21) Appl. No.: 14/867,181

(22) Filed: Sep. 28, 2015

(65) Prior Publication Data

US 2016/0090678 A1 Mar. 31, 2016

Related U.S. Application Data

(60) Provisional application No. 62/056,513, filed on Sep. 27, 2014.

(51) Int. Cl.

| | |
|---|---|
| ***D06F 33/02*** | (2006.01) |
| ***D06F 39/00*** | (2006.01) |
| ***D06F 35/00*** | (2006.01) |

(52) U.S. Cl.

CPC ..... *D06F 33/02* (2013.01); *D06F 35/00* (2013.01); *D06F 39/005* (2013.01)

(58) Field of Classification Search

CPC combination set(s) only.

See application file for complete search history.

(56) References Cited

U.S. PATENT DOCUMENTS

| | | | | |
|---|---|---|---|---|
| 6,374,644 | B1 * | 4/2002 | Rhode | D06F 37/08 24/58 |
| 6,732,553 | B2 | 5/2004 | Rhode et al. | |
| 2002/0007422 | A1 * | 1/2002 | Bennett | H04L 41/0213 709/246 |
| 2003/0054640 | A1 * | 3/2003 | Tamata | B01D 53/68 438/689 |
| 2004/0089030 | A1 | 5/2004 | Rhode et al. | |
| 2004/0231063 | A1 | 11/2004 | Rhode et al. | |
| 2005/0193500 | A1 * | 9/2005 | Rhode | D06F 37/08 8/158 |

(Continued)

FOREIGN PATENT DOCUMENTS

| | | |
|---|---|---|
| CA | 2363208 | 5/2002 |

*Primary Examiner* — Jarrett Stark

(74) *Attorney, Agent, or Firm* — Gina M. Lupino

(57) ABSTRACT

A system for the remote monitoring of washing machines cleanliness to a pre-certified cleanliness standard includes washing machines having wash processors to wash items according to pre-determined pre-certified recipes using pre-certified consumables. The wash processors are adapted to communicate over the internet with a remotely located administrator processor, to exchange information on a repeating, short-time interval. The wash processors provide to the administrator processor the volumetric consumption of consumables over successive wash loads. In each of said at least one washing machine according to said recipes, wherein said recipes correspond to characteristics of the wash items in each corresponding wash load and the corresponding nature of the spoilage. The recipes and the consumables have been independently pre-certified for use in the washing machines so as to clean and restore the wash items to a pre-determined certification standard of cleanliness.

20 Claims, 42 Drawing Sheets

(56) References Cited

U.S. PATENT DOCUMENTS

2005/0231354 A1* 10/2005 Riedel ..... A61N 1/39
340/531
2006/0279588 A1* 12/2006 Yearworth ..... B41J 29/393
347/6
2007/0073441 A1* 3/2007 Stonikas ..... G06Q 10/087
700/236
2008/0105134 A1* 5/2008 Elston, III ..... D06F 39/005
99/325
2008/0125911 A1* 5/2008 Ebrom ..... G06F 9/54
700/275
2010/0102082 A1* 4/2010 Ebrom ..... A47L 15/4293
340/3.1
2011/0247663 A1* 10/2011 Gadini ..... A47L 15/4454
134/115 R
2013/0231791 A1* 9/2013 Jacobs ..... G01R 21/133
700/291

* cited by examiner

EMERGENCY STOP INFO 222

THE EMERGENCY STOP BUTTON IS LOCATED TO THE LEFT OF THE SMALL TOUCH SCREEN YOU ARE CURRENTLY READING FROM. IF YOU ENCOUNTER AN EMERGENCY STOP FAULT, PLEASE DO THE FOLLOWING:

1. ENSURE THE EMERGENCY STOP BUTTON IS PULLED ALL THE WAY OUT.
2. TO ENSURE THE EMERGENCY STOP BUTTON IS IN THE CORRECT POSITION, PUSH THE BUTTON IN FIRMLY AND PULL OUT UNTIL YOU HEAR A POP.
3. PRESS "RESET ALARMS" AND CONTINUE WASHING.
4. IF THE FAULT CONTINUES TO OCCUR PLEASE CALL ESPORTA CUSTOMER SERVICE: 1-800-881-7781

FIG. 31

224

ALARMS ACTIVE

PRESS TO VIEW AND CLEAR ALARMS.

FIG. 32

SYSTEM FOR MONITORING RESTORATION QUALITY TO A THIRD PARTY CERTIFIED STANDARD OF SOFT OBJECTS BEING WASHED REMOTELY

CROSS REFERENCE TO RELATION APPLICATIONS

This application claims priority from U.S. provision application No. 62/056,513, filed on Sep. 27, 2014, which is incorporated herein by reference.

FIELD OF THE INVENTION

This invention relates to the field of washing and restoration of hard-to-restore items including soiled soft objects, and in particular to a system for monitoring restoration quality to a third party certified standard of soft objects being washed remotely.

BACKGROUND OF THE INVENTION

There are many examples where articles of clothing and other fabric or otherwise "soft" goods become soiled to the extent that often they are thrown away or used in a soiled condition because the goods cannot conventionally be returned to a clean state. To give one example: firefighters use outer wear which is of a fire-retardant fabric, better described below, which loses some of fire retardant properties as the fabric becomes soiled, notably with organics, smoke, soot, ash, mud, etc. Washing firefighting clothing must be done carefully so as to not disrupt the integrity of seams etc., and to a repeatable standard of cleanliness so that degradation of fire retardant capability is minimized and the fabric's fire retardancy restored to a predetermined and verifiably acceptable and safe level.

Washing such clothing has been accomplished using specialized large-object washing machines such as those provided commercially by Esporta Wash Systems Inc., the applicant herein. Descriptions of such machines are found in U.S. Pat. Nos. 6,374,644 and 6,732,553, which issued on Apr. 23, 2002, and May 11, 2004, respectively, for an Equipment Washer, and which are incorporated by reference herein. Such machines are also described in United States published patent applications 2004/0089030 A1, 2004/0231063 A1, and 2005/0193500 A1 published in May 13, 2004, Nov. 25, 2004 and Sep. 8, 2005, respectively, for an Equipment Washer, and which are incorporated by reference herein. In such machines the objects to be washed may be secured in bins or other means for immobilizing the object in a porous cage. An array of such cages may be formed around the perimeter of a porous rotary drum. The drum is mounted in a water-tight wash housing. Wash fluid; typically a combination of water, detergent, and other ingredients according to present formulas determined in accordance with the objects being washed, is introduced into the wash housing and the drum circulated through the wash fluid whereby hydraulic wash fluid pressure provides the cleaning medium as it is forced through and around the items being cleaned. Pre-set washing, rinsing, spinning, and extraction cycles are employed to remove the soilant from the objects, to then remove the detergents, etc. from the objects, and then to remove the moisture from the objects.

To give another example, restoration of objects salvaged from a fire, such as a residential home fire, or restoration of objects salvaged from flooding of a residence has been limited to date, hampered by lack of a trustworthy standard of cleanliness and a means to accomplish this within a verifiable monitoring system, so that presently often the objects are merely discarded and, to the extent possible, replaced with the proceeds of insurance coverage. Insurance companies thus are motivated to see such replacement more limited than is presently the case, so as to reduce the cost of insurance payouts, and the insured home-owners are motivated to see restoration in cases where replacement of soiled objects cannot be accomplished, for example, in the cases of irreplaceable clothing, or a child's loved stuffed animal toys, or heirlooms—the list goes on, as better described below.

In applicant's view it is preferable for the restoration industry, and in some instances, such as in the firefighting example, also a safety concern, to attempt to standardize standards of cleanliness which can be repeated and, importantly, verified including verified remotely, so as to allow the proliferation of restoration facilities employing the standards.

For items such as protective clothing worn by first responders such as firemen, the level of cleanliness and the manner of washing will affect the safety of first responder. For example, fire retardant clothing provides fire protection to specification when clean, for example when new, but with degraded fire retardancy when soiled. Further, if not washed in a specialized washing machine such the applicant's washing machine mentioned above or for example such as the washing machine described below, then there is a risk of damage to seams and fabric that may degrade the safety of the clothing. It is thus in these cases a matter of safety for the first responder that the operator of the washing machine not cut corners by for example using different wash fluid consumables such as different detergent than those recommended and supplied by the applicant for its washing machines.

In the case of a remotely operated washing facility, it is very difficult to monitor washing operation or to monitor an otherwise remotely located washing machine operator so as to detect when the pre-set and certified washing protocols are not being followed. Again, if the protocols are not followed, then the cleanliness standard may not be met, and thus the insurance company customers and the restoration company customers may be dissatisfied with goods which have been returned to them which have allegedly been cleaned and restored to the desired standard.

SUMMARY OF THE INVENTION

One mechanism for avoiding the cutting of costs or the otherwise cutting of corners by operators of remotely located washing facilities is to monitor consumption of the consumables that are to be used in the washing protocols. The operators have to elect which washing recipe they will use for a particular item or set of items. The system described herein records that election, and records when the washing has been done. Each recipe will require a unique set of consumables be used. Tracking the consumables actually used and comparing that to the washing recipes that have been used, and the number of times those washing recipes have been cycled, allows the tallying of use, comparison to on-site inventory of consumables, and thus the detection by the monitoring system of any shortcuts being taken by the operators.

Tracking the consumables that have actually been used has proven to be difficult where tracking relies solely on a fluid metering system, for example working in conjunction with the fluid pumps assigned to each type of fluid consumable (for example detergents, etc.). In applicant's experience, fluid flow and volumetric meters which are available commercially are sufficiently inaccurate at the lower viscosities associated with preferred consumables, that tracking of overall consumption of consumables by an operator using such meters is at present undesirable. Advances in fluid flow rate metering and fluid flow volume metering may allow the future use of such tracking, which may then be monitored by the networked system described herein below.

In the meantime, the system presently knows an initial level of each consumable associated with each machine, knows the wash load/recipe types that a particular washing machine has washed, and the number of those loads. The amount of consumable consumed for each such wash is thus known, as it has been pre-measured for each load type/wash recipe how much consumable is consumed by the operation of a particular pump for its pre-set run-time as prescribed for each wash recipe.

Consumables are shipped from the system administrator to an operator as the consumables are ordered and re-ordered by the operator. The system tracks the consumables for a particular machine, for example using bar coding on the consumables which matches a serial number or other unique identifier to the serial number or unique identifier on the particular washing machine in need of re-supply. For example, the consumables may be shipped in 20 liter pails, or in larger containers. So long as the system knows the volume of each consumable which is shipped to the operator for a particular washing machine and so long as the on-going tally of consumable consumption is maintained and monitored by the system and system administrator, the comparison to usage may also be maintained to thereby assist in verifying that the certified standard of cleanliness is being maintained.

In a preferred embodiment the system is advised of, for example tracks in real time, the arrival of consumables at an operator's premises. Tracking may for example be done by the scanning of barcodes on the containers of consumables for upload to the system by, RFID, by feedback from the shipper, etc., or any combination of these. The object is to seamlessly track the balance between the consumption of consumables for each washing machine, and the timely re-supply of consumables and input of those re-supplied consumables into the washing machines. In this fashion any use of un-authorized consumables, for example a potentially inferior detergent, by an operator will be detected by the system and the particular machine may then be shut-down remotely by the administrator.

The insurance industry is not in, and to applicant's knowledge has no interest in being in, the restoration business. The insurance industry needs to be able to rely, in every instance of restoration, on the standard to which difficult to restore items are being restored. If in extreme circumstances where an insured claimant commences litigation against the insurance company alleging failure of the company to abide by its contractual obligations to cover the claimant's loss, then in such circumstances the insurance company likely must be able to show and prove sufficient due diligence in performance of its obligations. How the insurance company meets its standard of care owed to the claimant, and how it proves that it has met its standard of care required by law, is likely critical if the insurance company is, firstly, to avoid unhappy claimants in the first place; and, secondly, avoid liability in the unavoidable few instances of unhappy insured claimants who either intractably perceive they have been wronged by inadequate restoration when damaged goods should rightfully have been replaced and not restored, or when the insured claimants are fraudulently attempting to collect a windfall from the insurance company based on a specious claim.

In the system described herein, the insurance company meets its standard of care by having pre-approved, or by having a third party pre-approve on its behalf, protocols for restoration of categories of goods to be restored, where the pre-approval is based on independent assessment and verification of the restoration protocols. That is, for example, an independent third party, trusted by the insurance industry, and who is a proven expert in restoration, tests restoration protocols in specific instances, especially where restoration has in the past been difficult or next to impossible, and verifies that the restoration protocols that have been tested, including the process and consumables being used and the corresponding equipment being used, consistently achieve restoration of the specified goods to a high level or otherwise certified level. In the present instance the certified level of cleanliness is known as food-grade-safe.

Restoration to food-grade-safe has proven in applicant's experience to be a safe, high-level standard that can be tested for using an ATP tester which reads so-called Relative Light Units (RLUs). Thus whether restoration to food-grade-safe has been achieved is easily tested and verified using an ATP tester. One such ATP tester is provided by Hygiena/Medical Packaging of Camarillo, Calif. USA. It may to some seem strange to be restoring goods such as textiles in clothing, etc. to a standard literally sufficient to eat off (i.e. food-grade-safe), as in reality, prior to the damage event (example: flooding, sewage leakage, fire, etc.) the insured claimant's goods would not likely have been food-grade-safe. However, the present system described herein provides for attaining food-grade-safe levels of cleanliness and restoration. That standard in applicant's opinion likely exhibits the insurance company's required standard of care in restoration of insured claimant's goods, and may in fact exceed the required standard of care to which an insurance company will be held. Using an ATP tester, in applicant's experience a food-grade-safe level of cleanliness is indicated by a reading of substantially equal to ten RLUs.

So having the insurance industry embrace food-grade-safe as the required standard for restoration, allowing the insurance industry to save costs by restoring goods rather than replacing them as was done in the past, then begs the question of how to implement on a mass market scale, restoration centers which will meet the food-grade-safe standard in every instance of restoration in a virtually fail-safe method. This is a very difficult thing to do, where the number of restoration centers operating daily will be in the hundreds, if not thousands globally. Overseeing such a network so as to substantially guarantee to the insurance industry that in most if not all cases the food-grade-safe standard is being met is not possible without:

a) automated oversight and administration provided by networked computers, for example networked over the internet;
b) the use of rigorously applied and enforced cleaning protocols including machine use procedures, recipes, and detergents and other consumables;
c) the use of standardized automated cleaning machines which interface and cooperate with the operator and, via computer network, the central administrator of the system;
d) the monitoring and analysis on a short-interval basis, for e.g. in real-time, of data received from every operational automated cleaning machine in every operational restoration center; and e) providing both-short interval reports summarizing the received short-interval, e.g. real time data, and other feedback to the central administrator to allow oversight and management by the central administrators as a fail-safe check on whether the food-grade-safe standard is being met by the operators.

In summary, the system for the remote monitoring of cleanliness to a pre-certified standard being achieved by washing machines as described herein may be characterized in one aspect as including:

At least one washing machine wherein each washing machine has a wash processor, and is adapted to wash items according to pre-determined pre-certified recipes using pre-certified consumables, which include pre-certified detergents. The consumables may be provided in removably couplable containers removably couplable to the washing machines. Each wash processor is adapted to communicate over the internet. An administrator processor, remote from the washing machines, adapted to communicate over the internet with each wash processor and to receive information from each wash processor on a repeating, short-time interval. Each said wash processor is adapted to provide to the administrator processor the volumetric consumption of consumables by its corresponding washing machine over successive wash loads according to the recipes. The recipes correspond to characteristics of the wash items in each corresponding wash load and the corresponding nature of the spoilage. The characteristics of the wash items may include what the items are made of; e.g. plastic, fabric, leather, foam/padding or otherwise puffy, etc., or any combination of such materials whether they are specialty wash items such as PPE, and whether the items are heavily, moderately or lightly soiled by various spoilants, for example from provider of insurance over the wash items against damage to the wash items by reason of at least one of the group of spoilants. The certification standard of cleanliness may be advantageously be food-grade-safe, for example defined as a measured RLU reading of substantially ten RLUs.

The administrator processor may use the information from the wash processor for each washing machine to track the consumption of the consumables by each washing machine, to track the available volume of the consumables available at each washing machine, and to compare the consumption of the consumables to the available volume of the consumables at each said washing machine, and to determine therefrom status information including an anticipated re-supply request for consumables from an operator of each washing machine. Upon failure to receive a re-supply request for any one washing machine the administrator or administrator processor may execute and deliver a remote warning, and/or shut-down of the corresponding washing machine.

In one embodiment the information provided to the administrator or administrator processor also includes tracking the re-supply of the re-supply consumables to determine an estimated arrival of the re-supply consumables at each washing machine. The information provided may include for example information updating the available volume of the consumables at each washing machine, and comparing a rate of consumption of the consumables to the available volume of consumables at each washing machine to determine an estimation of when the consumables will be substantially completely consumed by each washing machine and to thereby determine an anticipated re-supply request.

Where the group of wash items being washed includes heavy soiled items, the wash processor may reduce operator control of wash variables controlled by said wash processor for the corresponding washing machine. For example, the wash processor may substantially eliminate operator control of the wash variables for wash items.

In using the system, a method of use includes employing the pre-certified recipes and the pre-certified consumables that have been independently pre-certified by a third party certifier in each washing machine so as to clean and restore the wash items to a pre-determined certification standard of cleanliness approved by the provider of insurance over the wash items against damage to the wash items by reason of at least one of the group of spoilants.

BRIEF DESCRIPTION OF THE DRAWINGS

In the following illustrations like reference numerals denote corresponding parts in each view, wherein:

Washing Machine Embodiments

FIG. 31 shows a GUI of the emergency stop information screen of FIG. 24.

FIG. 32 shows a GUI of the alarms active screen of FIG. 24.

DETAILED DESCRIPTION OF EMBODIMENTS

Figure 1:
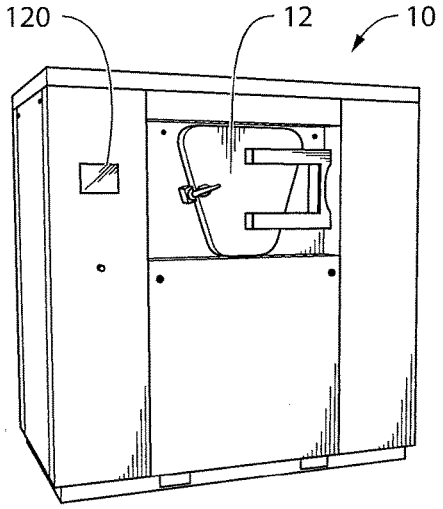
FIG. 1 shows a front, left-side perspective view of a washing machine according to one embodiment, with its front door closed.

The wash system as described herein is capable of cleaning both standard garments and textiles that conventionally may be cleaned in traditional washing machines, and is also capable of cleaning many other items that would never conventionally be washed in a regular or conventional washing machine. A list of such items, which is not intended to be exhaustive, of soft objects or other items (collectively referred to herein as soft objects or items) that may be washed in accordance with the wash system described herein is listed in Table 1 herein. The objective for washing of soft objects and other items which are not conventionally washed in conventional washing machines is to obtain cleanliness of the items to a certified standard. In the wash system described herein the example is provided of restoring soiled items to a certified standard referred to as "food-grade-safe".

The wash system restores wash items from all categories of insured losses including what would have been in the past replacement loss claims to soft wash items due to contamination by heavy smoke, soot, mold, blood, as well as category 2 and 3 (grey and black sewage) soiled water. The washing and restoration system as described herein may include processes as described by way of example hereinbelow, in conjunction with for example the use of the applicant's washing machines, one example of which is also described herein and another incorporated by reference above, where the washing is according to pre-certified washing and restoration protocols which have been certified by third party testing organizations such as Wonder Makers Environmental Inc., located in Kalamazoo, Mo., USA, who provide third party testing for compliance with certification standards.

Other certification testing may be performed by for example Caro Environmental Services of Kelowna, British Columbia, Canada, and by Northwest Labs of Calgary, Alberta, Canada.

In the case of testing done by Wonder Makers Environmental, Inc., an experimental study ("the Wonder Makers study") was undertaken to compare the effectiveness of a pre-curser wash system to the present wash system with cleaning procedures used by dry cleaning contractors of the Certified Restoration Dry-cleaning Network. The Wonder Makers study was to provide testing of a worst-case scenario where items where intentionally contaminated with smoke, sewage, mold, and blood. The intentionally contaminated representative items were sampled prior to cleaning. The items were them provided as a standard loss to contractors who have specialized in cleaning soft goods for the restoration industry so as to conduct a blind test by the contractors. The clean items were evaluated by a physical assessment and post-cleaning samples.

The physical assessment of the clean items along with laboratory sampling data generated during the study led to the conclusions that: (a) a large percentage of contaminated soft goods can be recovered after fires, floods, and bodily traumas if they are cleaned properly, (b) a substantial percentage of even intentionally difficult contaminated items can be successfully salvaged based on 3-part criteria of the cleaning contractors internal quality assessment standards, a detailed physical review, and sample results, (c) a stringent visual/odours evaluation of the clean items provided a relative accurate indicator of scientifically obtained results, (d) using stringent subjective standards regarding acceptability of stained residues and odour, and notwithstanding the dry-cleaning contractor declared the entire batch of contaminated items to be unsalvageable due to odour or staining, the wash system under study provided greater success in regards to salvageable items as compared to the cleaning processes used by the dry-cleaning contractors. These results were obtained in four different categories; namely, regular fabrics, bulky or quilted, that is, "puffy" materials, leather goods, and materials designated as "dry clean only". The four forms of contamination used represented the most common kinds of damage to soft goods recovered by restoration contractors; namely, sewage, mold, blood, and smoke.

Example of Washing Machine

A sequence of views in FIGS. 1-25 illustrate a washing machine, and the use of that washing machine, capable of the required protocols within the wash system described herein.

Figure 1A:
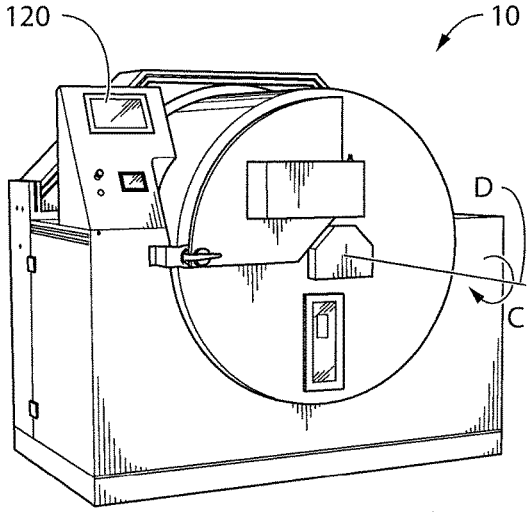
FIG. 1*a* shows a left perspective view, a further embodiment of a washing machine

In FIG. 1, the front face of the front housing 10*a* of washing machine 10 is shown with its front door 12 in its closed and latched position. An alternative embodiment of a washing machine 10 is shown in FIG. 1*a*.

Figure 2:
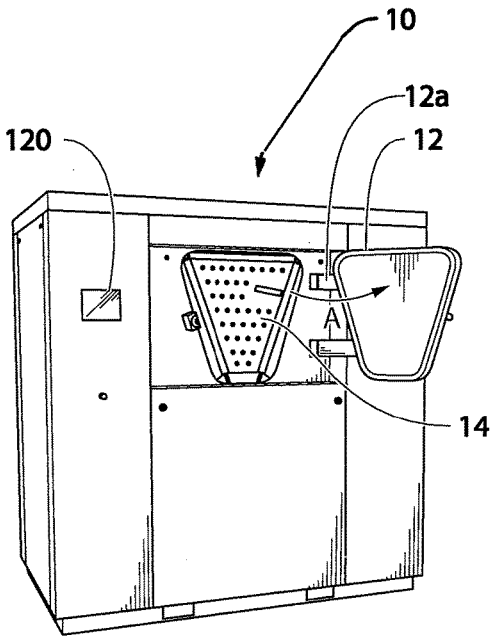
FIG. 2 shows a front elevation view, the washing machine of FIG. 1 with the front door being swung open and items for washing being held waiting for loading into the washing machine.

In FIG. 2 front door 12 has been swung open in direction A on its hinges 12*a* so as to expose a perforated cage door 14 which, when stationary, is aligned behind door 12 when door 12 is closed. That is, both front door 12 and cage door 14 are aligned with the same opening in front housing 10*a* so as to provide access from the front of machine 10 into the cage behind the cage door 14.

Figure 4:
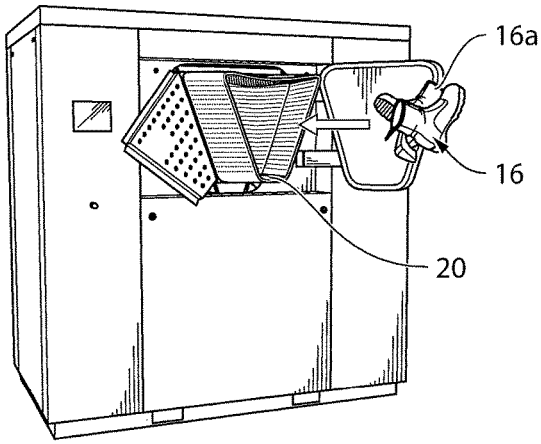
FIG. 4 shows the washing machine of FIG. 3 showing the internal basket having been slid from inside the compartment receiving the items to be washed.

In FIG. 4, items to be restored 16, which may include soft items, hard items, or combinations of soft and hard items, are shown by way of example suspended in front of machine 10 awaiting insertion into the washing machine.

Figure 3:
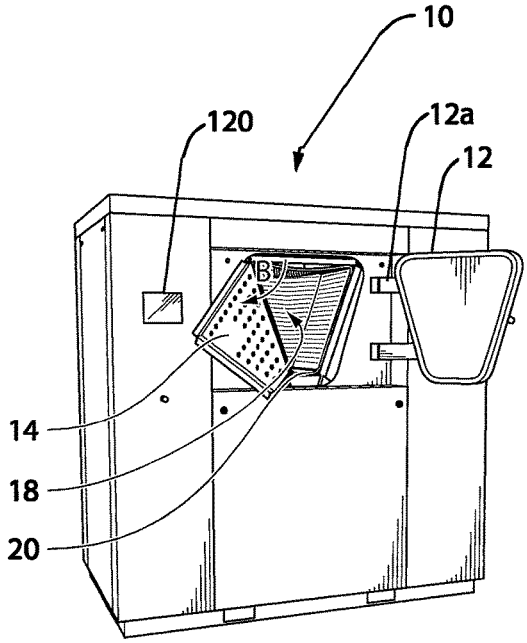
FIG. 3 shows the washing machine of FIG. 2 wherein the exposed compartment of the rotating cage or drum contained within the washing machine is shown with the cage or drum door open and the items to be washed being loaded into the compartment.

In FIG. 3, cage door 14 is in its open position having been swung open in direction B about its corresponding hinges to thereby expose the opening 18 into the corresponding perforated basket 20. Basket 20 is snugly, slidably mounted in the cage behind the corresponding cage door 14. The cage is better described below.

In FIG. 4, basket 20 is shown pulled from within the corresponding cage, and items 16 are inserted into basket 20.

Figure 5:
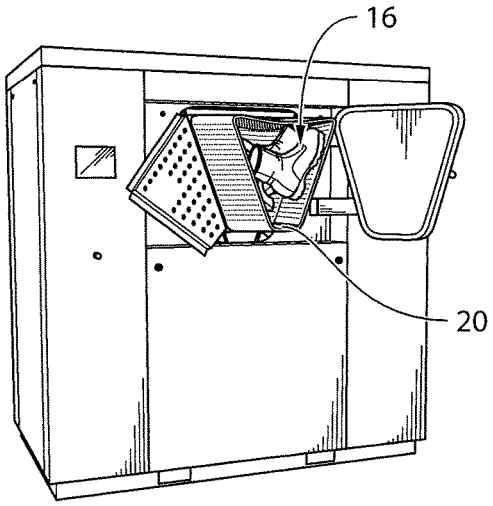
FIG. 5 shows the washing machine of FIG. 4 with the items to be washed having been loaded into the basket and the basket being reinserted into the compartment of the rotating cage or drum.
Figure 6:
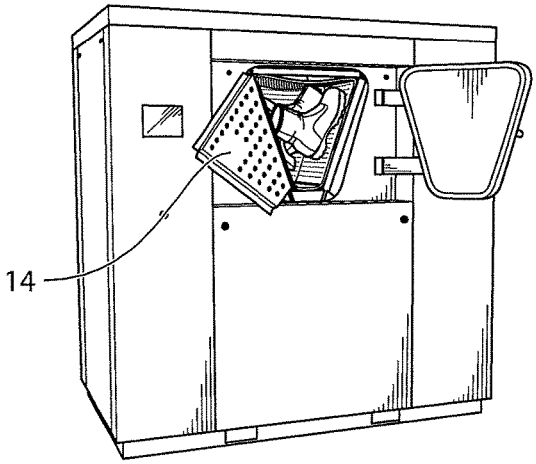
FIG. 6 shows the washing machine of FIG. 4 with the basket fully reinserted into the compartment of the rotating cage or drum.
Figure 21:
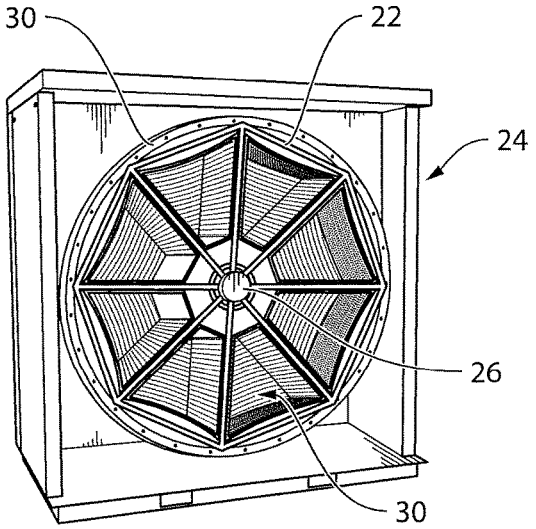
FIG. 21 shows the washing machine of FIG. 20 with the compartment doors removed so as to show the front openings of the compartments of the rotating cage or drum.

In FIGS. 5 and 6 basket 20 containing items 16 has been slid back into the corresponding cage within segmented rotary drum 22 seen for example in FIG. 21.

Figure 4A:
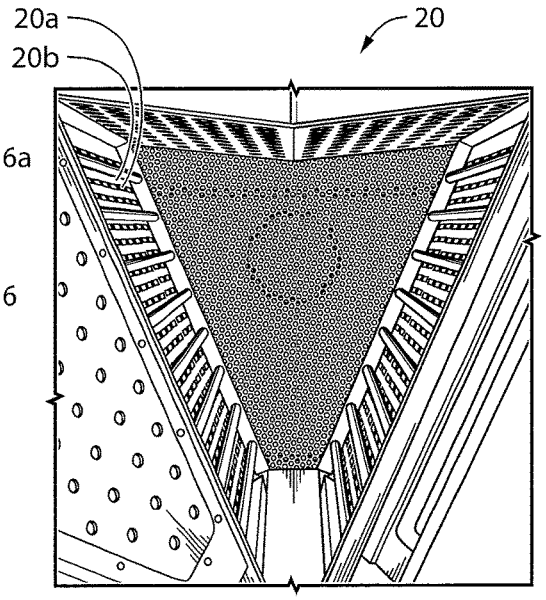
FIG. 4*a* shows a front, close-up view of an embodiment of a compartment of the rotating cage or drum mounted in the washing machine.

As seen in FIG. 4*a*, the inside of basket 20 is significantly ventilated or perforated by extensive rows of apertures or cut-outs 20*a*, which allow the circulation of washing fluids under pressure into, and through, the basket 20. The washing fluids also circulate through any items 16 contained within the basket. The extensive number of apertures or cut-outs 20*a* provide, for example, openings in the sidewalls 20*b* of basket 20 which may be equal to or greater than 50 percent of the area of the sidewalls 20*b*.

Basket 20 is fully reinserted into the corresponding cage, hereinafter also referred to as a cage segment 24, in rotary drum 22. In the illustrated example, which is not intended to be limiting, rotary drum 22 has a cross sectional circumference, shown in front elevation view, in the shape of an octagon. The octagonal shape of the circumference is due to the triangular shaped cross section of each cage segment 24. Rotary drum 22 provides eight triangular compartments; that is, eight cage segments 24 into which corresponding baskets 20 are snugly received in their sliding engagement therein.

Figure 7:
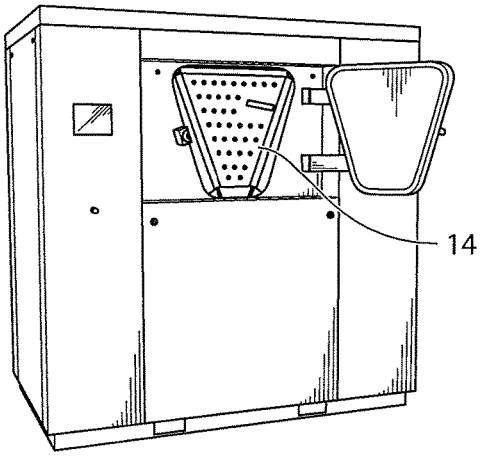
FIG. 7 shows the washing machine of FIG. 6 with the compartment door being closed.
Figure 8:
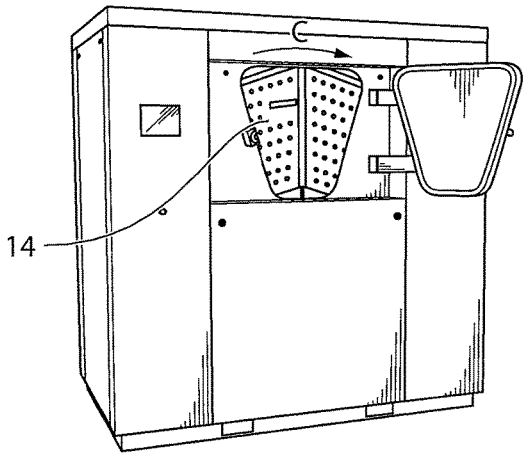
FIG. 8 shows the washing machine of FIG. 7 with the compartment door fully closed and the rotating drum or cage being rotated so as to expose the next adjacent compartment ready for loading.
Figure 17:
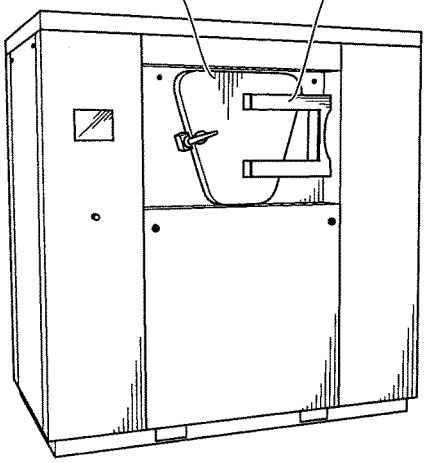
FIG. 17 shows the washing machine of FIG. 16 with the front door in its closed and latched position.

With the basket 20 containing the items 16 returned fully into the corresponding cage segment 24 as seen in FIG. 6, cage door 14 is closed as seen in the sequence in FIGS. 7 and 8. With door 12 closed as seen in FIG. 17, the variable speed motor (not shown) drives a transmission (not shown), for example a geared or pulley transmission, mounted for example within the rear of machine 10. The motor and transmission is engaged according to machine instructions from a programmable logic controller (PLC) and corresponding processor described better below or other wash processor so as to rotate rotary drum 22. Rotary drum 22 may rotate for example clockwise in direction C. Rotary drum 22 is rotated by the operation of the motor and corresponding transmission so as to rotate drum 22 about axis of rotation D on drive axle 26. Axis of rotation D is better seen in FIG. 1*a*, but is similarly aligned with respect to the washing machine 10 of FIG. 1. That is, FIG. 1*a* is an illustration of a further alternative embodiment of a washing machine 10 showing more clearly axis of rotation D.

Figure 9:
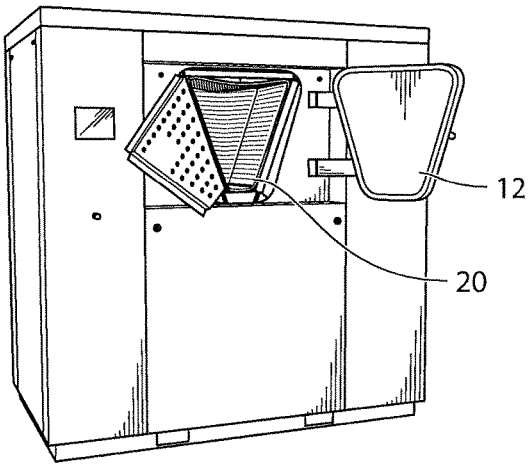
FIG. 9 shows the washing machine of FIG. 8 wherein the rotating cage or drum has been rotated, stopped and the next adjacent compartment opened, its basket slid outwardly of the compartment, and further items to be washed inserted into the basket.

Continuing with the sequence described above, in FIG. 8 rotary drum 22 is rotated in direction C. In FIG. 9, rotary drum 22 has been rotated so as to align the next adjacent cage segment 24 with opening 18 behind door 12.

Figure 10:
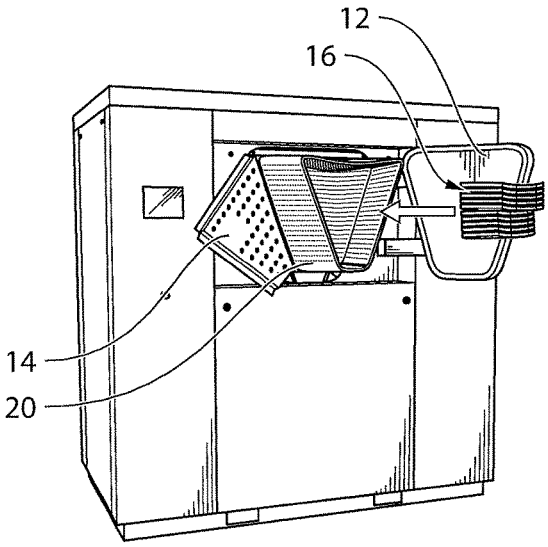
FIG. 10 shows the washing machine of FIG. 9 with the items to be washed fully inserted into the basket and the basket being return into the compartment of the rotating cage or drum.
Figure 11:
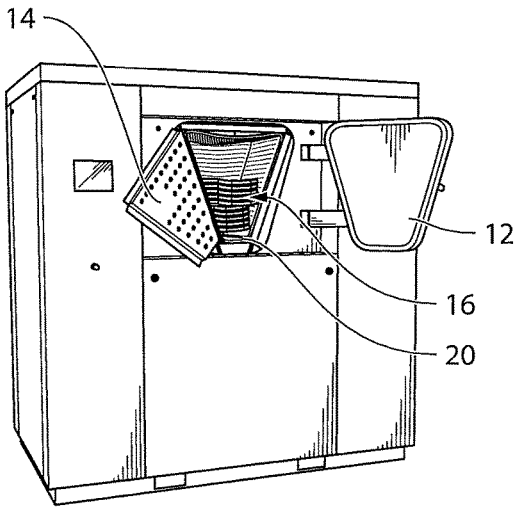
FIG. 11 shows the washing machine of FIG. 10 with the basket fully inserted.
Figure 12:
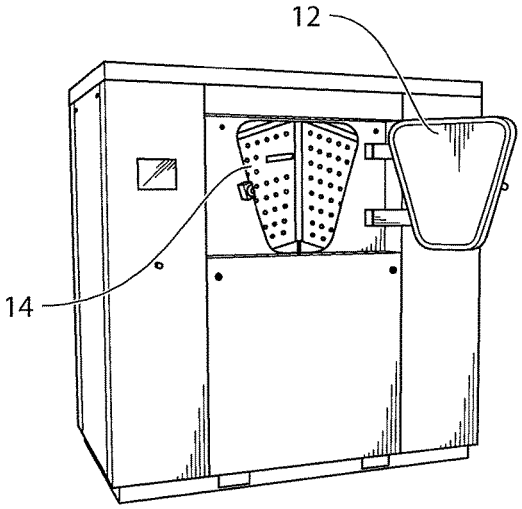
FIG. 12 shows the washing machine of FIG. 11 with the compartment door closed, ready for the rotating cage or drum to be rotated to the next adjacent compartment, showing further items to be washed held waiting for loading.
Figure 13:
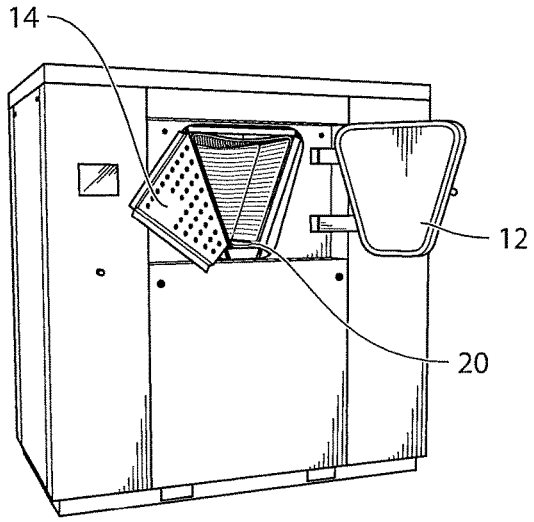
FIG. 13 shows the washing machine of FIG. 12 showing the third load of items being inserted into the corresponding third compartment basket.

As seen in FIG. 10, further items 16 are loaded into a second basket 20 corresponding to the second cage segment 24. Then, with items 16 within basket 20, again basket 20 is slid entirely into the correspondent cage segment 24 as seen in FIG. 11, and the corresponding cage door 14 is closed as seen in FIG. 12.

Advantageously, a pin and receiver or other positive locking mechanism is provided for each cage door 14 on each cage segment 24 of rotary drum 22 so as to prevent inadvertent opening of a cage door 24 during rotation of rotary drum 22, for example during wash, rinse, spin or extract cycles. Such a positive locking mechanism is provided so that an operator of machine 10, once the cage door 14 exposed in opening has been shut, may positively lock that cage door 14 in its closed position. Locking pins 14*a* are illustrated diagrammatically by way of example in FIG. 20. Locking pins slide into, for example a female receiver (not shown).

Figure 14:
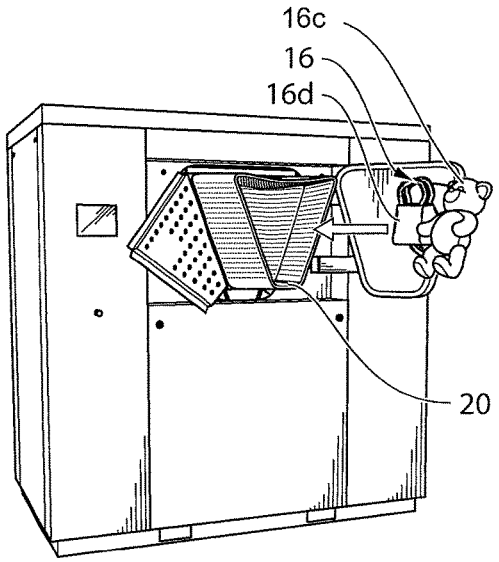
FIG. 14 shows the washing machine of FIG. 13 with the third load of items to be washed having been fully inserted into the basket and the basket being returned into its compartment.
Figure 15:
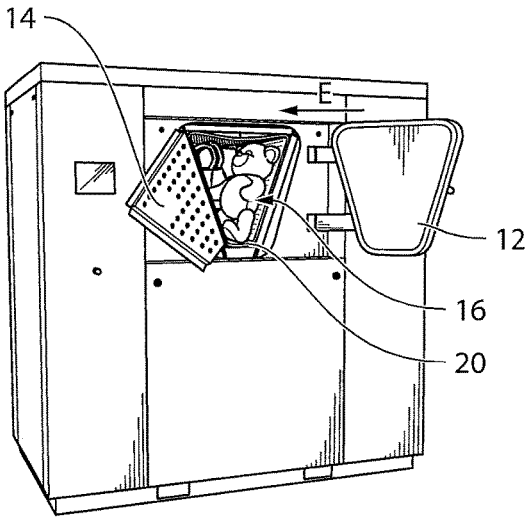
FIG. 15 shows the washing machine of FIG. 14 wherein the compartment has been loaded and the compartment door closed and latched.
Figure 16:
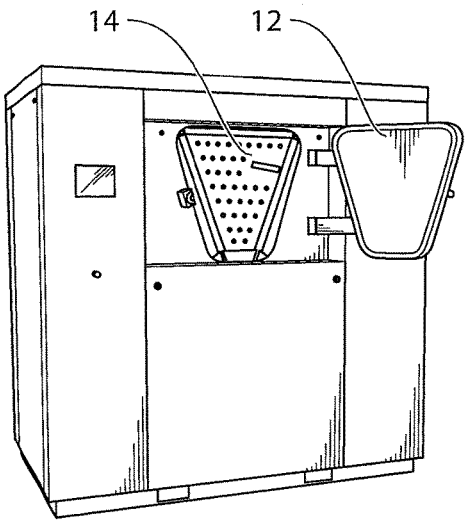
FIG. 16 shows the washing machine of FIG. 15 with the front door of the washing machine being closed.

In FIG. 14, further items 16, including in the illustrated example a stuffed toy animal 16*c* and purses 16*d*, are shown suspended waiting for placement into the next available basket 20 in the next adjacent cage segment 24. In FIG. 15, items 16 are being inserted into basket 20, and, as before, basket 20 is then inserted in direction E as to slide the basket completely back into its corresponding cage segment 24 within rotary drum 22. In FIGS. 16 and 17 respectively, cage door 14 has been closed and locked shut, and door 12 is closed and latched, or otherwise locked, so as to enable the operation of the washing, rinsing, spinning and extraction cycles better described below.

Figure 18:
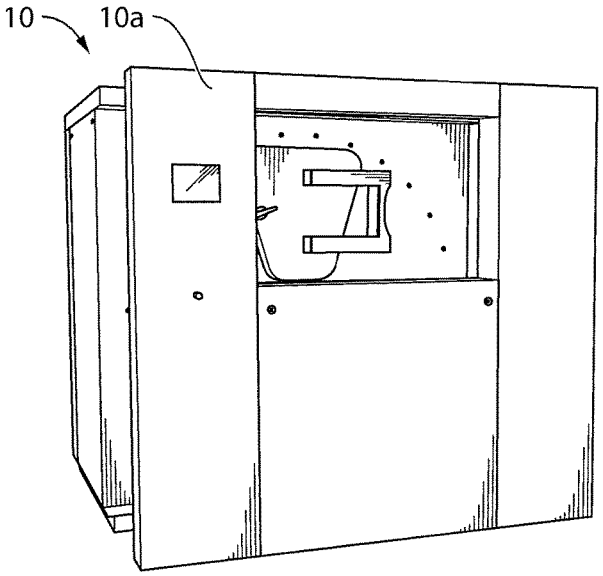
FIG. 18 shows a right-side perspective view of the washing machine of FIG. 17 with the front-face of the washing machine housing pulled away from the machine.
Figure 19:
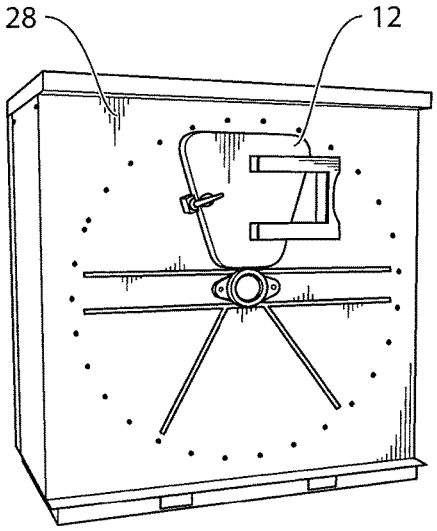
FIG. 19 shows the washing machine of FIG. 18 with the front-face of the washing machine housing removed so as to expose the front-face of the sealed wash housing.
Figure 20:
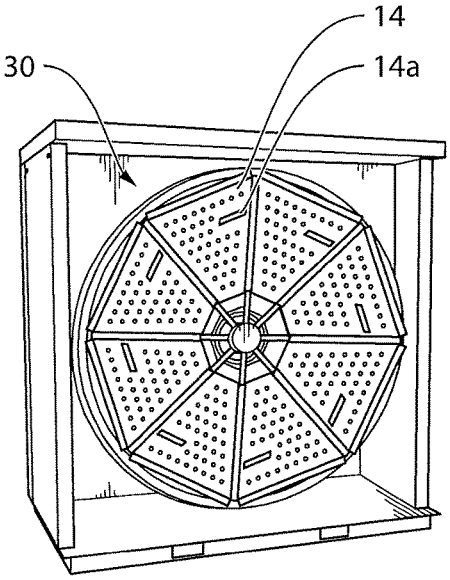
FIG. 20 shows the washing machine of FIG. 19 with the front-face of the wash housing removed so as to expose the front-face and compartment doors of the rotating cage or drum mounted within the sealed wash housing.

In FIG. 18, the front housing 10*a* of washing machine 10 is shown pulled away from the front face of the rigid internal wash support structure 28. As seen in FIG. 20 wash housing 30 is mounted behind the front face of support structure 28 as seen in FIG. 19. Support structure 28 supports the front of wash housing 30. Wash housing 30 contains the various wash fluids during the various wash cycles while rotary drum 22, and its corresponding cage doors 14, are rotated through the wash fluids. The wash and rinse fluids are selectively pumped into (and drained from) wash housing 30 according pre-programmed, operator selectable operation of the washing machine via its processor. It is understood that wash housing 30 when mounted to support structure 28 at the front of wash housing 30, and when mounted to other support structure (not shown) within washing machine 10, provides a sealed wash tub environment in which rotary drum 22 may be rotated through wash fluids in the tub or in which rotary drum 22 as seen in FIG. 21 may be rotated at high speed to force fluids out by centrifugal force so that the fluids may be drained from the wash housing.

It is also understood, although not shown, that various replaceable containers of detergent and other wash fluids, for example, fragrances, sanitizers, etc. would ordinarily be located adjacent washing machine 10, for example to the rear of the machine, or in some embodiments located within washing machine 10 so as to be easily replaced as the fluids are consumed from within the containers. The fluid containers may advantageously be removably mounted to for example, corresponding hoses having corresponding pumps (not shown). The pumps pump the various fluids under pressure into wash housing 30. The fluid containers are removably coupled to their corresponding hoses or other fluid conduits and are thus removably coupled so as to be in fluid communication with the washing machine, and in particular with rotary drum 22.

One of the desired cleaning mechanisms provided by the wash system is that the items 16 within baskets 20 within the porous cage segments 24 of rotary drum 22 are impinged by the various wash fluids which are injected or sprayed under pressure into rotary drum 22. The various wash fluids impinge items 16 through various and numerous apertures in the cage segments 24 (wherein cage segments 24 and rotary drum 22 may for example be a very sturdy segmented wire cage), and through apertures 20*a* in baskets 20, so as to permeate the bulk of the various soft or hard wash items 16 to thereby more effectively clean the wash items.

In some instances hard wash items may themselves contain soft items requiring cleaning. For example, sports helmets are rigid on the outside and contain soft or spongy materials on the inside, and it is often the case that it is the interior soft and spongy materials that require cleaning, in many cases more than the rigid materials on the exterior. A balance must be achieved between, firstly, vigorously circulating the soft materials of items 16 through the wash fluids as they are injected or sprayed in wash housing 30 or as the wash fluids are turbulently tumbling in wash housing 30 as rotary drum 22 is rotated within wash housing 30, and secondly, inhibiting damage to the rigid or hard items or components of the items.

With the correct sizing of baskets 20 and corresponding cage segments 24, or for example by the use of inserts such as mesh holders or bags on folding or rigid frames (not shown), wash, items 16 may be held sufficiently snuggly and separated within their corresponding basket 20 so as to not only be cleaned but also to inhibit damage to the various items 16 caused by the items moving around within basket 20. Advantageously basket 20 may be constructed of soft or compliant plastics so as to minimize damage to items 16. In some cases, item 16 may have further containment within baskets 20, for example porous bags, etc. (not shown) to assist in the holding of the various items 16 within their corresponding basket 20.

In FIG. 20 the front support structure 28 has been removed so as to expose the interior of wash housing 30 and the front faces of cage doors 14. The positive locking pins 14*a* are shown slidably mounted to the front of each cage door 14. Pins 14*a* may engage for example latching apertures or the like mounted to, or formed in, the corresponding spokes on the front face of rotary drum 22, for example, the illustrated spokes which define the front openings of each cage segment 24.

In one preferred embodiment, not intended to be limiting, the washing machine motor and corresponding transmission, for example a pulley system, for rotationally driving drive axle 26 is adapted to provide not only relatively slow rotational agitation cycles but also high rate of rotation fluid extraction cycles. Slow rotational agitation cycles may be provided for example when each cage segment 24 is to be rotated through washing fluid 32 which has been pumped into wash housing 30, during which the combined fluid resistance and the weight of the tumbling fluids passing through the cages segments 24, baskets 20, and items 16 within wash housing 30, combined with the wet weight of items 16 may put significant loading and strain on the drive system including the motor and transmission. In the illustrated embodiment, which is not intended to be limiting, the total dry weight of items 16 held in all cage segments 24 may, collectively, be in the order of 120 pounds. Advantageously, during loading of items 16, their dry weight is somewhat evenly distributed around rotary drum 22.

During wash fluid extraction and spin cycles, in order to obtain sufficient centrifugal separation of wash and rinse fluids from items 16, which may be highly retentive of fluid, rotary drum 22 may have to be rotated on drive axle 26 at high rotational speeds, for example at speeds exceeding 200 rpm, so as to generate for example centrifugal forces, measured as multiples of the force of gravity (g's), in the order of 50-70 g's acting on items 16. The motor loading, and strain on the transmission, at these speeds may, consequently, again be high. At such high rotational speeds, and creating such high centrifugal g forces, it has been found that the framework supporting wash housing 30 etc. must be significantly robust.

Figure 22:
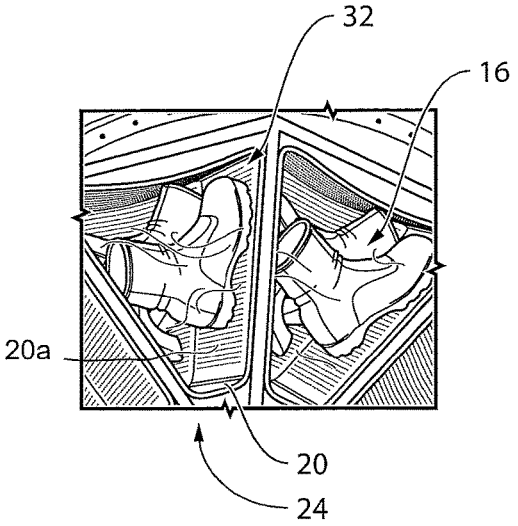
FIG. 22 shows a left perspective view, two of the compartments of the rotating cage or drum of FIG. 21 showing various items held, separated, within the compartments during agitation of the compartments through wash fluid contained within the wash housing.

As seen in closer detail in FIG. 22, wash water 30 is driven under pressure through the apertures in the bars of cage segments 24 and through apertures 20*a* in baskets 20 so as to impinge as a spray or flow of droplets of various wash fluids driven through the apertures under pressure as the cage segments 24 and their items 16 being carried in the baskets 20 therein are subjected to spray. Items are sprayed for example when they are in upper most portions of the rotational trajectory of the items being washed. The items 16 are turbulently mixed in the collected wash fluids while being continuously circulated when in the lower portions of the rotational trajectories of the items being washed.

Pumps may be those provided by Knight Canada™ of Mississauga, Ontario, Canada. Metering may be meters such as those provided by Burkert Fluid Control Systems™ of Burlington, Ontario, Canada.

Example of Data Flow within Washing System

Figure 23:
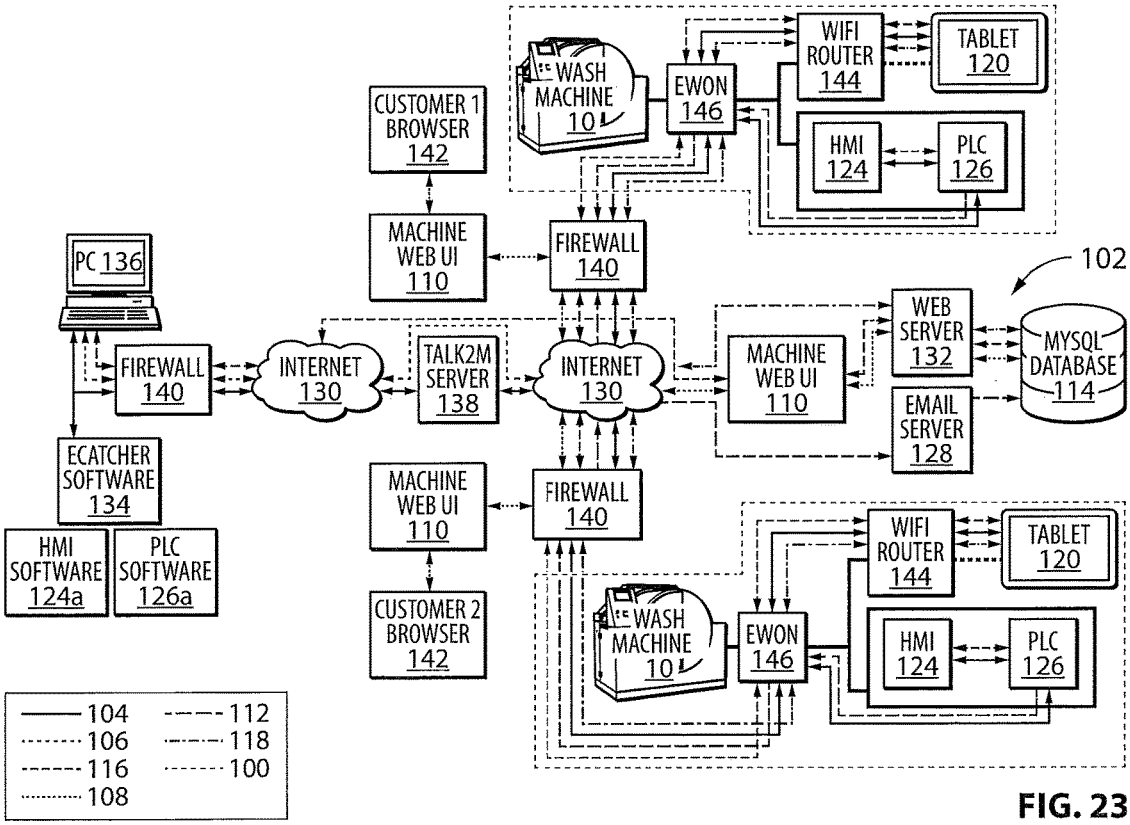
FIG. 23 shows various data flow paths between the system administrator and two remote washing locations.

A diagrammatic representation of the data flow in one embodiment of the washing system is illustrated in FIG. 23. In FIG. 23 the ovals 100 denote the remote locations of the operators of one or more of washing machines 10. As used herein, each operator also referred to as a Customer. Although only two remote locations 100 are illustrated in FIG. 23, it is understood that this is by way of example only as, and as stated above, the number of remote locations 100 may run into the hundreds or thousands.

Each washing machine 10 at each remote location 100 has a data connection between the remote location 100 and a system administrator 102 and/or corresponding administrator processor (collectively system administrator 102) which may be located at great distance from any one of remote locations 100. Some form of contractual arrangement may exist between the system administrator 102, or the corporate entity for whom the system administrator 102 works, and the Customers or operators at remote locations 100. Under such contractual arrangement the Customers or operators, or their corporate legal entities, are bound to follow the protocols set out below by way of example, and thus provide restoration of items 16 to a certified standard such as the food-grade-safe standard or such other standard as may be required by the insurance industry from to time-to-time.

In FIG. 23, each of the data flow paths is indicated by separate lines which denote different data flows as set out in the Data Flow Legend in Table 2.

The dashed data flow lines 104, as set out in Table 2, denotes a two way communication link that allows the administrator 102 to remotely monitor machine activity of machines 10 at remote locations 100, perform machine diagnostics remotely, install program updates remotely, and, as necessary, remotely turn washing machine 10 on or off as better described below.

The solid data flow lines 106, as set out in Table 2, denotes a two way communication link between the system administrator 102 or its employees, for example machine technicians and cleaning technicians, and the remote Customer or operator at remote locations 100, using for example instant messaging, voice calls, video calls, etc.

The hash mark data flow lines 108, as set out in Table 2, denotes a two way communication link that allows the Customer at remote location 100 to view and report specific wash system machine analytics provided by the administrator 102, for example, the number of wash loads, the detergent usage, the cost to the Customer per wash loads, the number of washes etc. Data flow 108 allows the Customer to review and report the Customer's machine analytics from any internet browser through a secure administrator machine web User Interface (UI) 110.

The data flow lines 112, which consist of a row of "+" symbols as set out in Table 2, denote a one way communication that sends machine analytic data, (for example date, time, wash load number, detergents usage (for example, in millilitres), water temperature, water usage, etc. by email (for example in "csv" file format) to the administrator email server 128 which is then parsed and deposited into the administrator data base 114.

The data flow lines 116, which consist of a row of dots as set out in Table 2, denotes a two way communication link that allows an administrator employee to view, add, edit, delete administrator wash system machines analytics, for example, the number of wash loads, the detergent usage, the cost per wash load, the number of washes etc. from any internet browser through a secure machine web user interface 110.

The data flow lines 118, which consist of a row of dashes alternating with "x's" as set out in Table 2, denotes a two way communication link that allows the administrator 102 to remotely view, edit, add, delete, and report the analytic data generated by each Customer wash system at remote location 100 and also to view, edit, add and delete the content (for example the frequently ask questions (FAQ), the training videos, the maintenance videos, etc.) provided by the administrator 102 and access by the Customers at remote locations 100 though either the machine tablet 120 or any browser enabled device.

The data flow line 122, which is denoted by a corrugated line as set out in Table 2, denotes a two way communication that provides touch screen operated instructions from the human machine interface (HMI) 124 to the wash processor including the programmable logic controller (PLC) 126 which operates the components of the washing machine 10 (for example, to run or stop the washing machine motor, to open or close various drain valves, to open or close pumps, etc.).

Again with reference to FIG. 23, although not intending to be limiting, the following may be provided by administrator 102 for the use of the employees of administrator 102: email server 128 which interfaces between internet 130 and data base 114, web server 132 which interfaces between internet 130 and data base 114, and in the case of data flows 116 and 108, via machine web user interface 110. Email server 128 and web server 132 interfaces directly between internet 130 and data base 114 by data flows 112 and 118 respectively.

HMI software 214*a*, PLC software 126*a* and E-catcher software 134 are enabled on PC 136 and interface with Talk2M server 138 via internet 130 and firewall 140, with the exception that data flow 116 bypasses Talk2M server 138.

The Customers or operators at remote locations 100 may access machine web user interface 110 using any internet browser 142 so as to thereby interface with the administrator web server 132 via machine web user interface 110 and firewall 140. At remote locations 100, data flows 106, 104, and 118 exchange data between tablet 120, used by the operator to control, in one preferred embodiment, washing machine 10 via WIFI router 144, and the "EWON" virtual private network router 146.

In one embodiment of the present system the above network may be employed, modified as need be and as would be known to one skilled in the art, to help avoid the cutting of costs or the otherwise cutting of corners by operators of the remotely located washing facilities by monitoring consumption of the consumables that are to be used in the washing protocols. The operators have to elect which washing recipe they will use for a particular item or set of items. The system records that election, and records when the washing has been done. Each recipe requires a unique set of consumables be used. Tracking by the administrator of the consumables actually used and comparing that to the washing recipes that have been used, and the number of times those washing recipes have been cycled, allows the tallying of use, comparison to on-site inventory of consumables, and thus the detection by the administrator of short-cuts being taken by the operators.

Tracking the consumables that have actually been used has proven to be difficult where tracking relies solely on a fluid metering system, for example working in conjunction with the fluid pumps assigned to each type of fluid consumable (for example detergents, etc.). In applicant's experience, fluid flow and volumetric meters which are available commercially are sufficiently inaccurate at the lower viscosities associated with preferred consumables, that tracking of overall consumption of consumables by an operator using such meters is at present undesirable such meters may however be employed as the technology improves. Thus, advances in fluid flow rate metering and fluid flow volume metering may allow the future use of such tracking, which may then be monitored by the networked system.

In the meantime, presently the administrator in this embodiment of the system knows an initial level of each consumable associated with each machine, knows the wash load/recipe types that a particular washing machine has washed, and the number of those loads. The amount of consumable consumed for each such wash is thus known, as it has been pre-measured for each load type/wash recipe how much consumable is consumed by the operation of a particular pump for its pre-set run-time as prescribed for each wash recipe.

Consumables are shipped directly or indirectly from the system administrator to an operator as the consumables are ordered and re-ordered by the operator. The system tracks the consumables for a particular machine, for example using bar coding on the consumables which matches a serial number or other unique identifier to the serial number or unique identifier on the particular washing machine in need of re-supply. For example, the consumables may be shipped in 20 liter pails, or in larger containers. So long as the system knows the volume of each consumable which is shipped to the operator for a particular washing machine and so long as the on-going tally of consumable consumption is maintained and monitored by the system and system administrator, the comparison to usage may also be maintained to thereby assist in verifying that the certified standard of cleanliness is being maintained.

In a preferred embodiment the system is advised of, for example tracks in real time or other more intermittent intervals, but advantageously no longer than short-intervals such as several times per day for example, the arrival of consumables at an operator's premises. Tracking may for example be done by the scanning of barcodes on the containers of consumables for upload to the system by, RFID, by feedback from the shipper, etc., or any combination of these. The object is to more or less seamlessly track the balance between the consumption of consumables for each washing machine, and the timely re-supply of consumables and input of those re-supplied consumables into the washing machines. In this fashion any use of un-authorized consumables, for example a potentially inferior detergent, by an operator will be detected by the administrator and the particular offending machine may then be shut-down remotely by the administrator.

Washing Machine Operator Control

Figure 24:
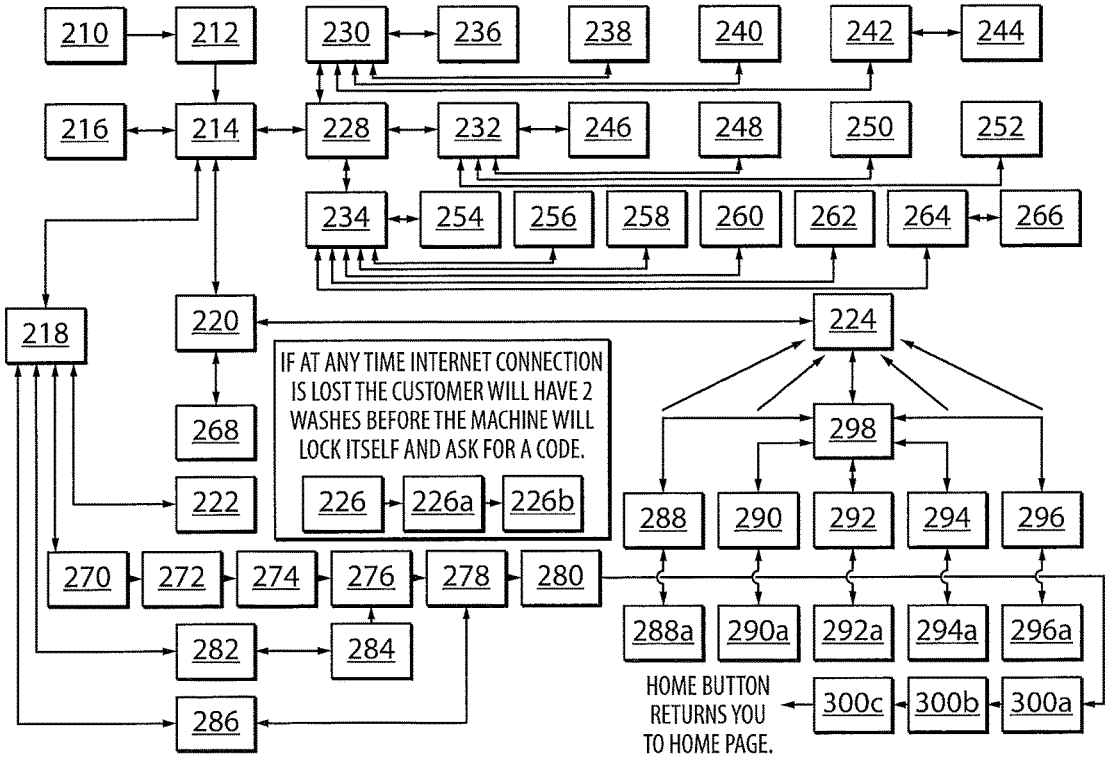
FIG. 24 shows a flowchart graphical user interface (GUI) screens according to one example for the operation of a washing machine showing, diagrammatically, the inter-relationship between each of the screens.
Figure 25:
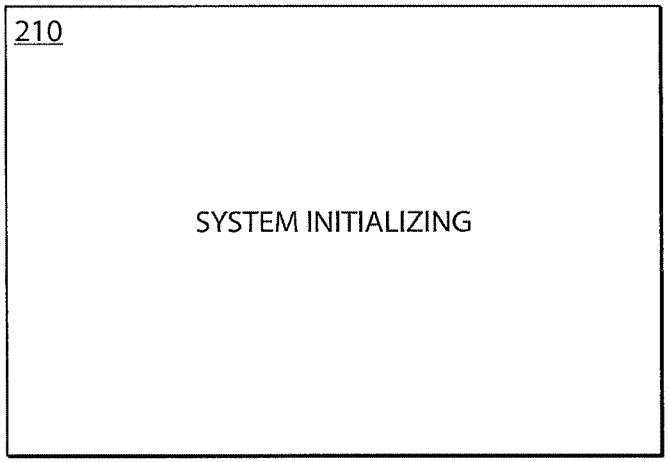
FIG. 25 shows a GUI of the system initializing screen of FIG. 24.

FIG. 24 is a diagrammatic representation of the interrelationships between the various user interface screens which an operator would see and interact with on tablet 120 so as to control the operation of washing machine 10. As seen in FIG. 24, upon initial start-up of washing machine 10 and its corresponding controller, a system initializing screen, as seen in better detail in FIG. 25, is displayed. In FIG. 24 the system initializing screen is denoted by a reference numeral 210. FIG. 24 also illustrates one example of a system fault. Other system faults which may occur, as would be known to one skilled in the art, are not shown.

Figure 26:
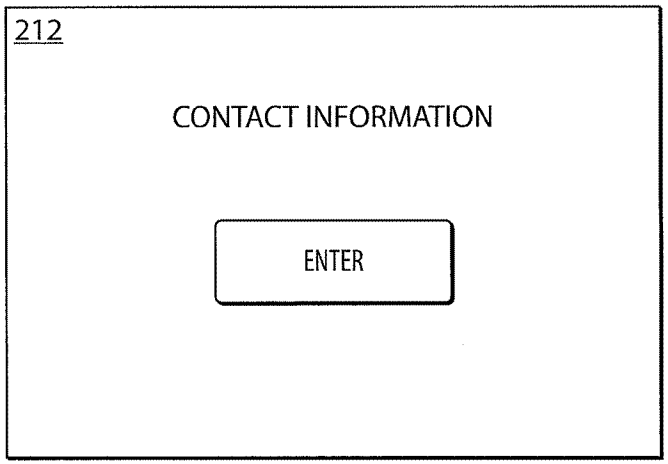
FIG. 26 shows a GUI of the enter button screen of FIG. 24.
Figure 27:
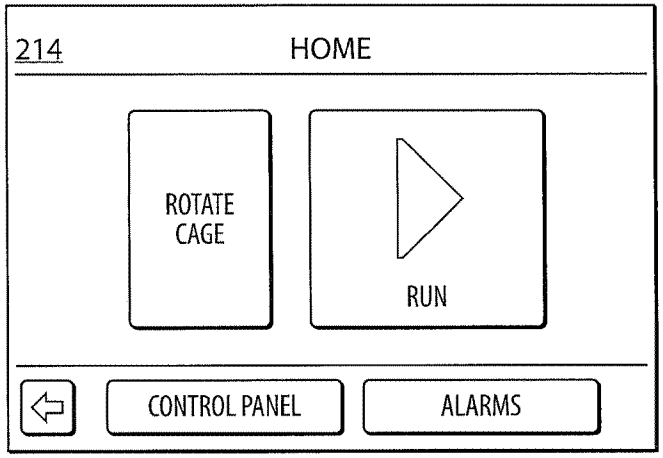
FIG. 27 shows a GUI of the home screen of FIG. 24.
Figure 28:
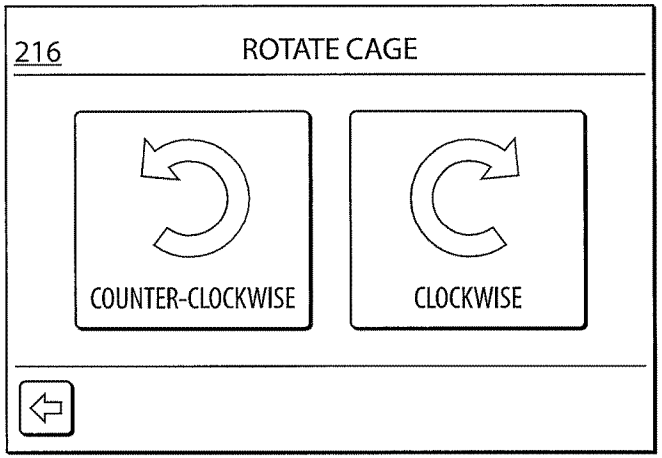
FIG. 28 shows a GUI of the rotate cage screen of FIG. 24.

Once the system is initialized, the "enter" screen 212, as better seen in FIG. 26, is displayed. Once the operator has entered into the system according to a pre-established verification protocol, such as a password or the like, home screen 214, better seen in FIG. 27 is displayed. At home screen 214, the operator may select to rotate the cage using the "rotate cage" button, that is, so as to rotate rotary drum 22 to a desired load or unload position, which then takes the operator to the rotate cage screen 216. The use of the rotate cage function is described above for loading and unloading the washing machine 10. The operator may then select either the "counter-clockwise" button or the "clockwise" button on the touch screen to rotate the cage, as described above, so as to load or unload items 16 into, or from, another basket 20. The operator may then select the "back-arrow" button, in the lower left-hand corner of the screen, so as to return to home screen 214. The rotate cage screen 216 is better seen in FIG. 28.

Figure 29:
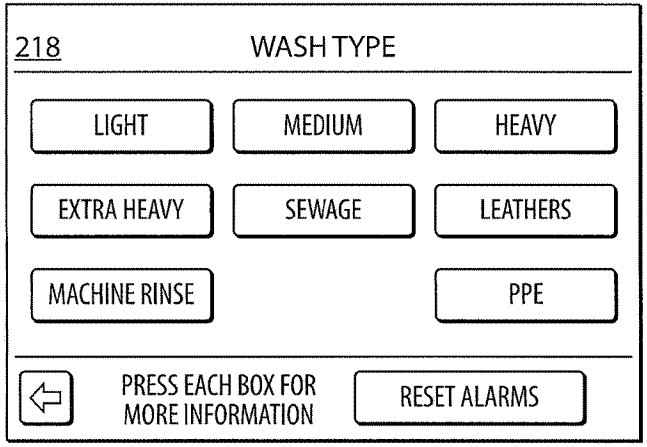
FIG. 29 shows a GUI of the wash type screen of FIG. 24.

From the home screen 214, the operator may select the "run" button which then takes the operator to wash type screen 218, better seen in FIG. 29. From wash type screen 218, the operator may then select the details of the desired wash load as better described below.

Figure 30:
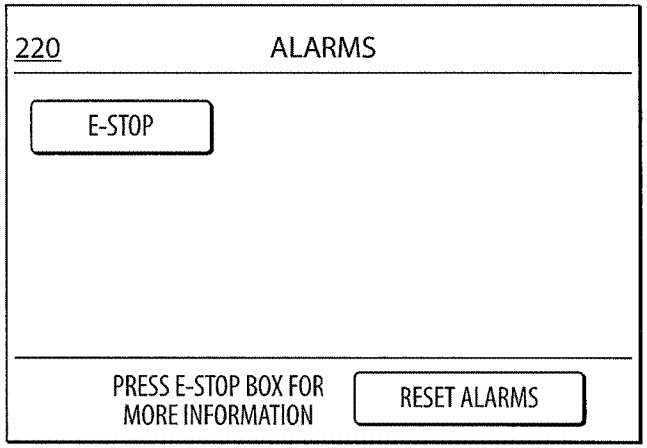
FIG. 30 shows a GUI of the alarms screen of FIG. 24.

Using the "back" button on wash type screen 218, the operator is returned to home screen 214. If the operator selects the "alarms" button on the home screen the operator is taken to the alarms screen 220, better seen in FIG. 30. The operator may then select the "E-stop" button at any time the washing machine is operating, which then takes the operator to the emergency stop information screen 222, better seen in FIG. 31. If the E-Stop button is depressed the machine motor brake will be activated and all functionality will be stopped and not usable until the Estop is pulled out and the alarm on the HMI is reset. On return to the alarms screen 220 the operator may select the "reset alarms" button which then takes the operator to the alarms active screen 224, better seen in FIG. 32. As indicated in FIG. 24, the alarms may become present at any time during a particular wash cycle.

Figure 33:
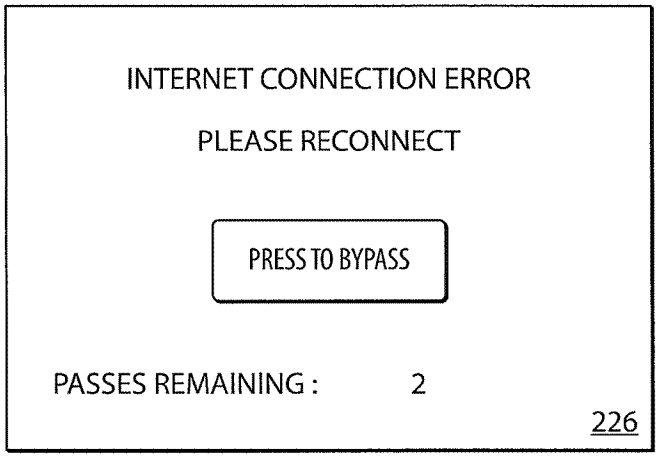
FIG. 33 shows a GUI of the first internet connection error screen of FIG. 24.
Figure 34:
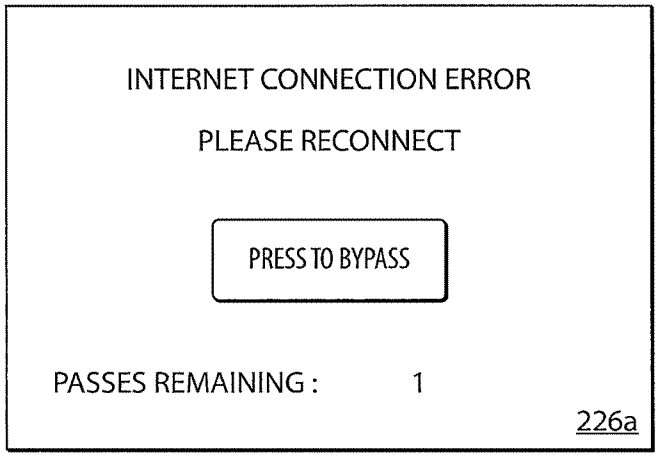
FIG. 34 shows a GUI of the second internet connection error screen of FIG. 24.
Figure 35:
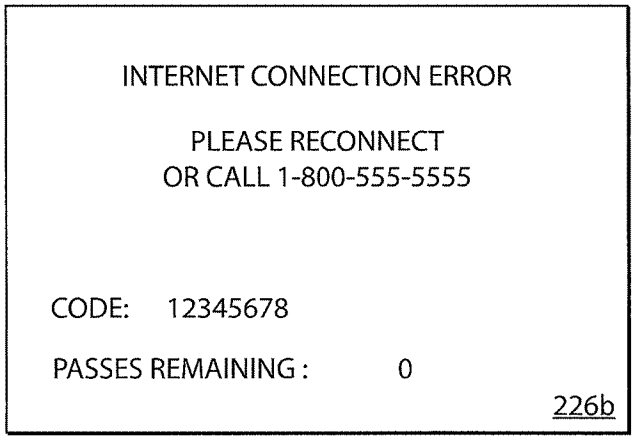
FIG. 35 shows a GUI of the final internet connection error screen of FIG. 24.

As also indicated in FIG. 24, if at any time connection to internet 130 is lost the Customer is given, for example, a further two washes for that disconnected machine 10, after which that machine 10 will automatically lock itself and ask the operator for a code. As seen in internet connection error screen 226, better seen in FIG. 33, upon loss of internet connection from machine 10 to internet 130, screen 226 is displayed which asks the operator to reconnect to the internet and gives the operator the option to bypass screen 226 to allow the operator to run a wash without internet connection. The operator is warned of the number of bypasses remaining upon selection of a first bypass. In the event of selection of a first bypass, the operator screen 226 is replaced with screen 226*a* which warns the operator that, in one embodiment not intended to be limiting, only a single bypass remains. The operator may select the "bypass" button again to operate the washing machine 10 one further time without internet connection following which internet connection error screen 226*b* is displayed which prompts the operator for a password key or the like which may be obtained by contacting the administrator 102. The screen also prompts the operator to simply reconnect to the internet. The screens 226*a* and 226*b* are better seen in FIGS. 34 and 35 respectively.

Figure 36:
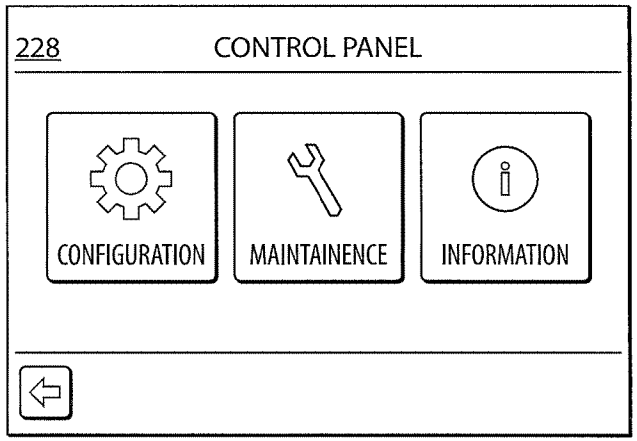
FIG. 36 shows a GUI of the control panel screen of FIG. 24.
Figure 37:
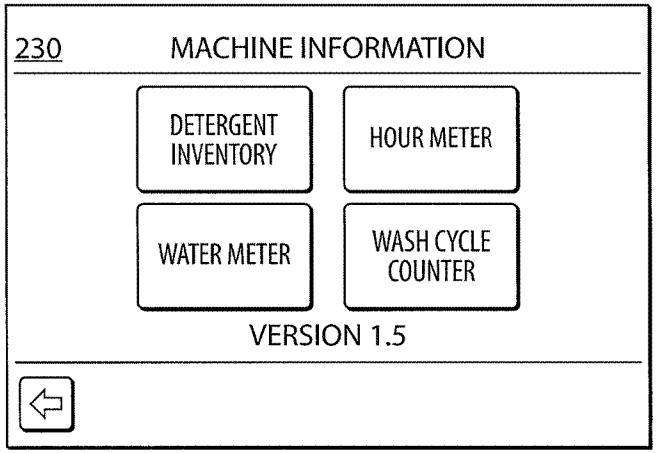
FIG. 37 shows a GUI of the machine information screen of FIG. 24.
Figure 38:
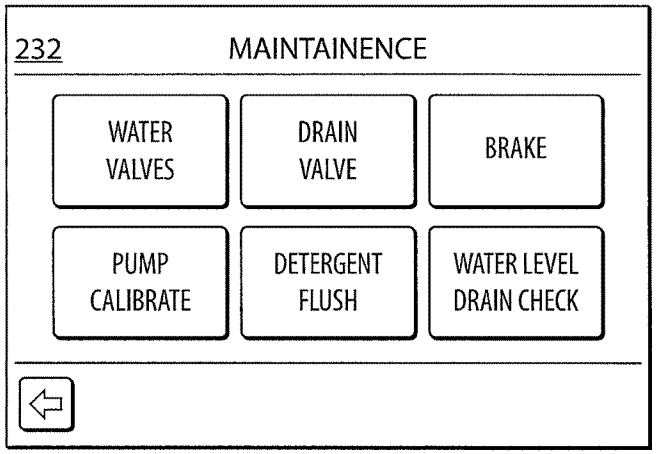
FIG. 38 shows a GUI of the maintenance screen of FIG. 24.
Figure 39:
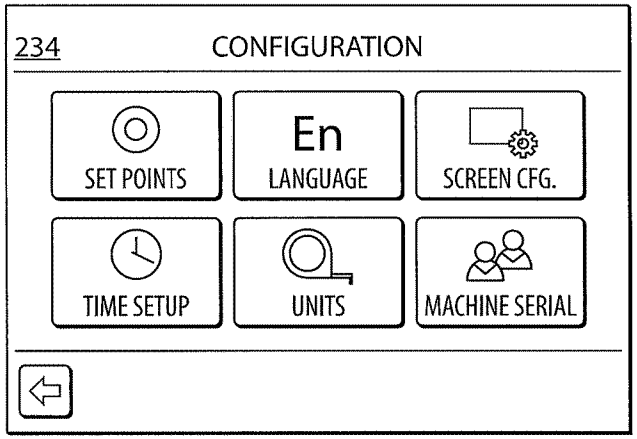
FIG. 39 shows a GUI of the configuration screen of FIG. 24.

If the operator returns to home screen 214, or had remained at home screen 214, and had selected the "run" button, then the operator is taken to the "control panel" screen 228, better seen in FIG. 36. Once in the control panel screen 228, the operator may select from three choices; namely, the machine "information" button which takes the operator to the machine information screen 230, better seen in FIG. 37; or the operator may select the "maintenance" button in which case the operator is taken to the maintenance screen 232, better seen in FIG. 38; or the operator may select the "configuration" button in which case the operator is taken to the configuration screen 234, better seen in FIG. 39.

Figure 40:
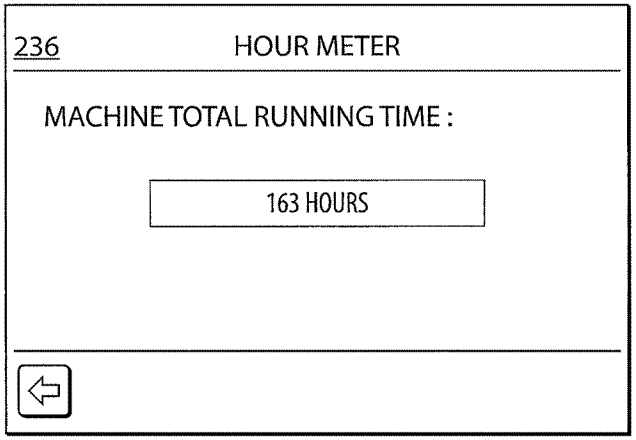
FIG. 40 shows a GUI of the hour meter screen of FIG. 24.
Figure 41:
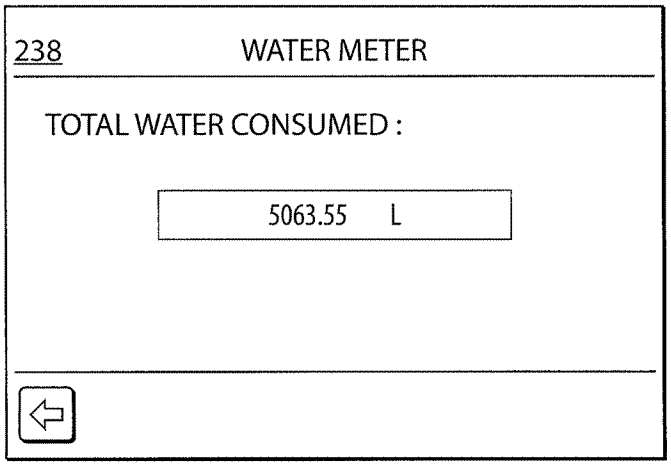
FIG. 41 shows a GUI of the water meter screen of FIG. 24.
Figure 42:
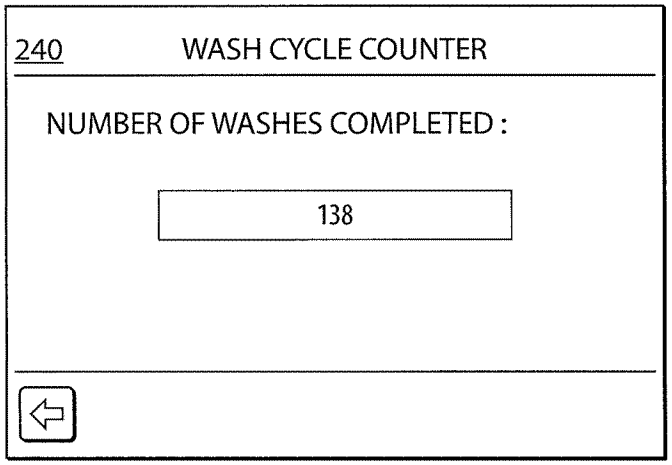
FIG. 42 shows a GUI of the wash cycle counter screen of FIG. 24.
Figure 43:
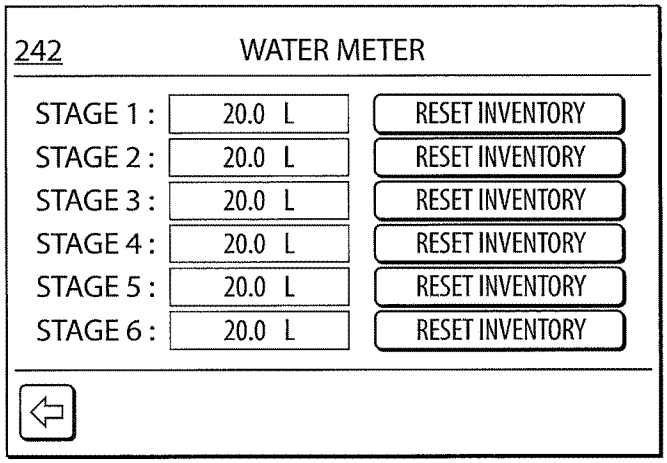
FIG. 43 shows a GUI of the detergent inventory screen of FIG. 24.

In the instance that the operator had selected the machine information screen 230, the operator may then select one of four buttons; namely the "detergent inventory" button, the "hour meter" button, the "water meter" button, or the "wash cycle counter" button. If the operator selects the "hour meter" button, then the operator is taken to the hour meter screen 236 better seen in FIG. 40. If the operator selects the "water meter" button, then the operator is taken to the water meter screen 238, better seen in FIG. 41. If the operator selects the "wash cycle counter" button then the operator is taken to the wash cycle counter screen 240, better seen in FIG. 42. If the operator selects the "detergent inventory" button then the operator is taken to the detergent inventory screen 242, better seen in FIG. 43. The operator may return to the machine information screen 230 from any of these screens 236, 238, 240, and 242, by selecting the "back" button, denoted by the return arrow in the lower left-hand of each screen.

Figure 44:
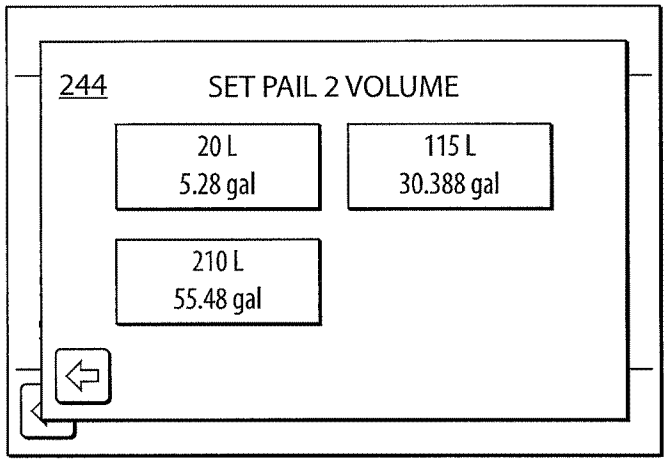
FIG. 44 shows a GUI of the set pail volume screen of FIG. 24.

When the operator is in the detergent inventory screen 242, the operator is presented with a stacked array of "reset" buttons, in the illustrated embodiment which is not intending to be limiting, six reset buttons corresponding to six displayed "Stages". Each reset button, labelled "reset inventory" in screen 242 takes the operator to a corresponding "set pail volume" screen 244 better seen in FIG. 44. Each of these Stages 1-6 correspond to the various consumable fluids, for example the detergent fluid used in each of Stages 1-3 of a particular cycle of the washing cycle as determined by the recipe as selected by the operator, and better described below. The detergents etc. in stages 1-3 are described by way of example in Table 6. The operator selects the recipe according to the category of goods to be restored. Depending on the recipe, the fluid pump (not shown) associated with consumables container, for example a pail, for a particular Stage is engaged, so, depending on the recipe, as to supply a select combination of fluids from the various pails corresponding to the various Stages at any particular time in a cycle during the entire wash, rinse, spin or extraction cycles. Thus in the illustrated example the operator has viewed the volume in pail 2 which corresponds to Stage 2, and having reviewed the amount of Stage 2 detergent left in the pail, swapped the pail out for a full pail of Stage 2 detergent and reset the inventory for that pail so that the system knows that a full pail is available.

Figure 45:
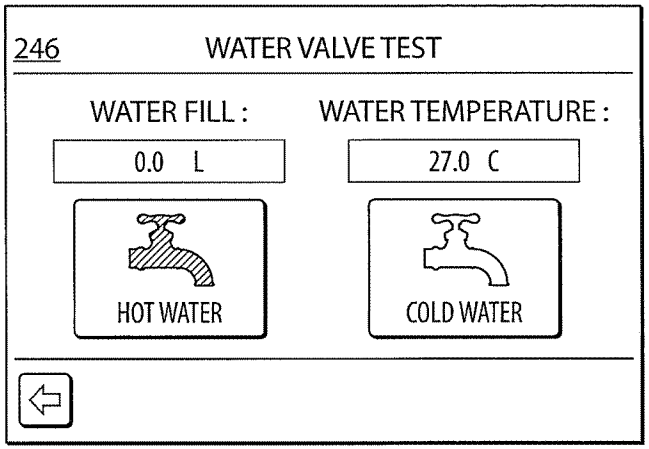
FIG. 45 shows a GUI of the water valve test screen of FIG. 24.
Figure 46:
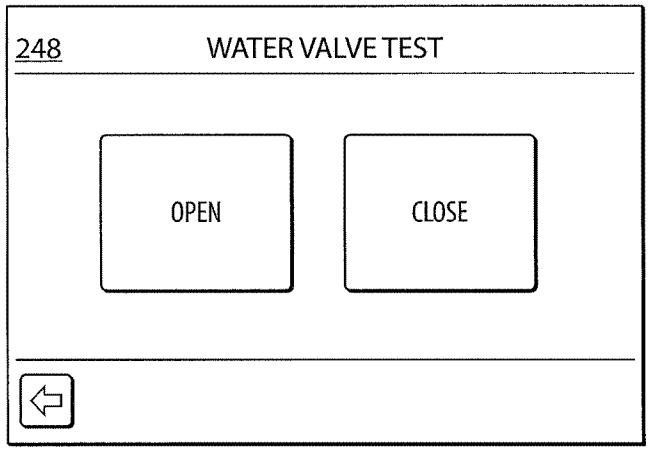
FIG. 46 shows a GUI of the drain valve test screen of FIG. 24.
Figure 47:
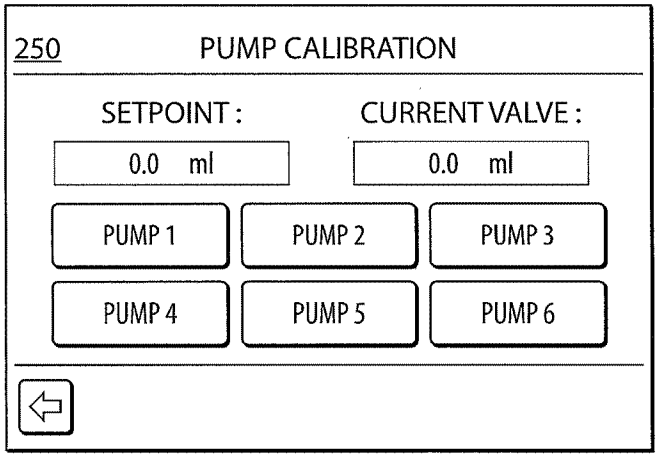
FIG. 47 shows a GUI of the pump calibration screen of FIG. 24.
Figure 48:
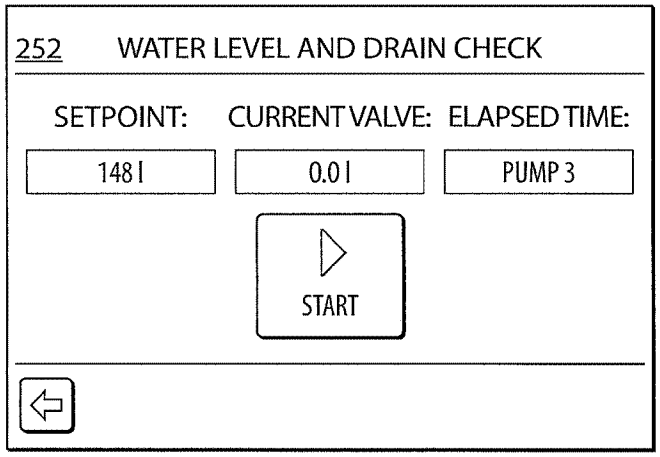
FIG. 48 shows a GUI of the water level and drain check screen of FIG. 24.

Returning now to the instance where the operator has selected the maintenance screen 232 from the control panel screen 228, the operator in maintenance screen 232 has a selection of six buttons to choose from; namely, a "water valves", a "drain valve", a "brake" button, a "pump calibrate" button, a "detergent flush" button and a "water level drain check" button. The "brake" button engages the brake which arrests rotation of rotary drum 22. The detergent "flush" button flushes the detergent from the system. The "water valves" button takes the operator to the water valve test screen 246, better seen in FIG. 45. The "drain valve" button takes the operator to the drain valve test screen 248, better seen in FIG. 46. The "pump calibrate" button takes the operator to the pump calibration screen 250, better seen in FIG. 47. The water "level drain check" button takes the operator to the water level and drain check screen 252, better seen in FIG. 48.

Figure 49:
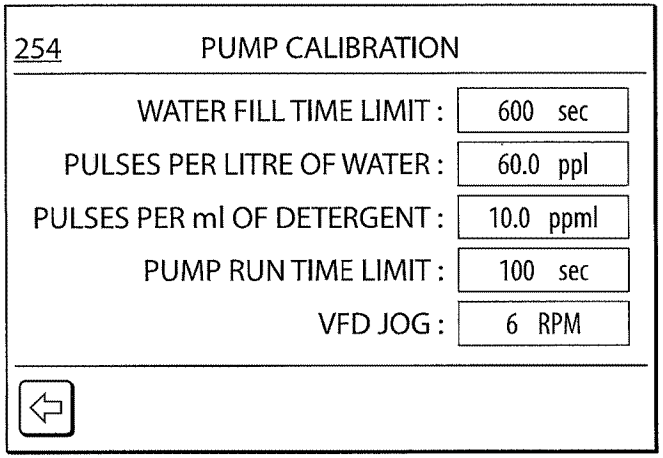
FIG. 49 shows a GUI of the set points screen of FIG. 24.
Figure 50:
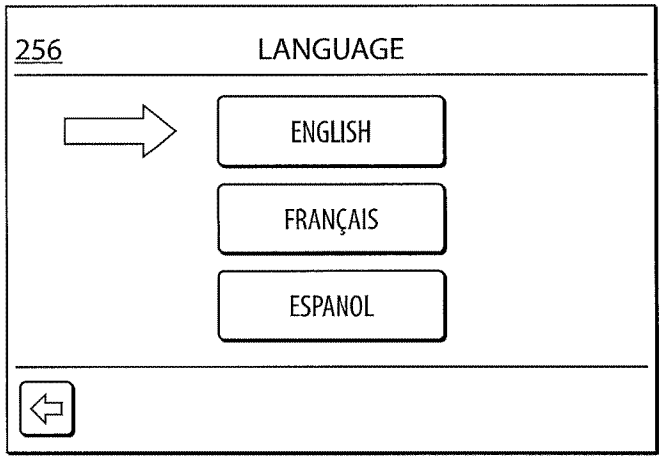
FIG. 50 shows a GUI of the language screen of FIG. 24.
Figure 51:
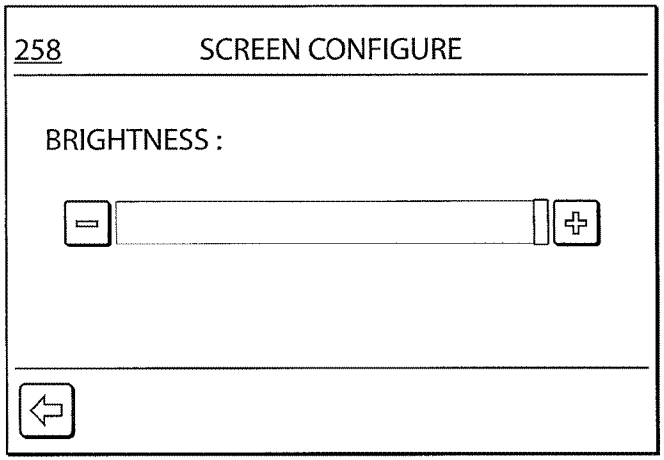
FIG. 51 shows a GUI of the screen configure screen of FIG. 24.
Figure 52:
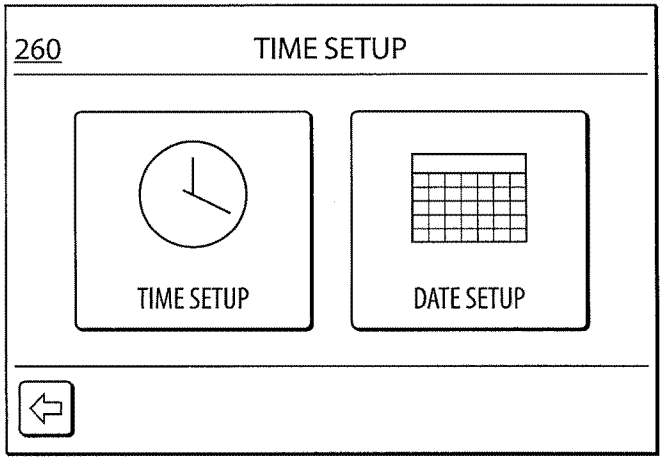
FIG. 52 shows a GUI of the time set-up screen of FIG. 24.
Figure 53:
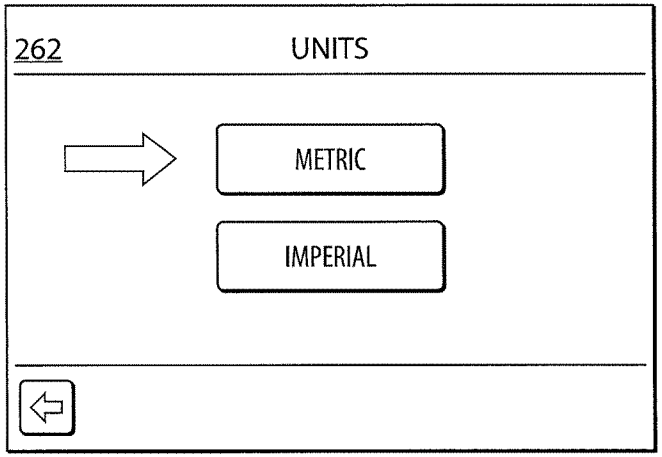
FIG. 53 shows a GUI of the units screen of FIG. 24.
Figure 54:
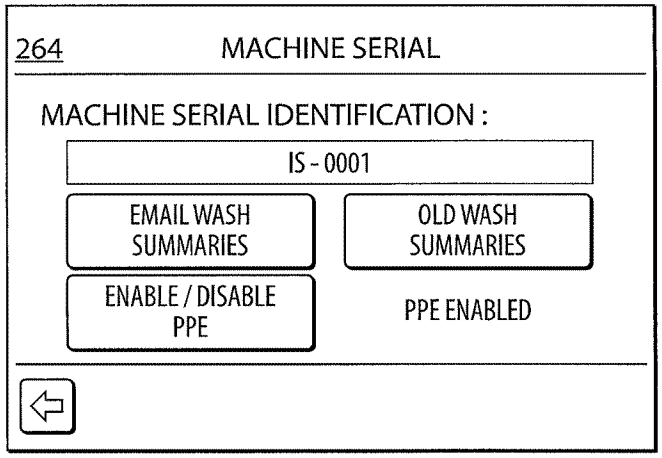
FIG. 54 shows a GUI of the machine serial screen of FIG. 24.
Figure 55:
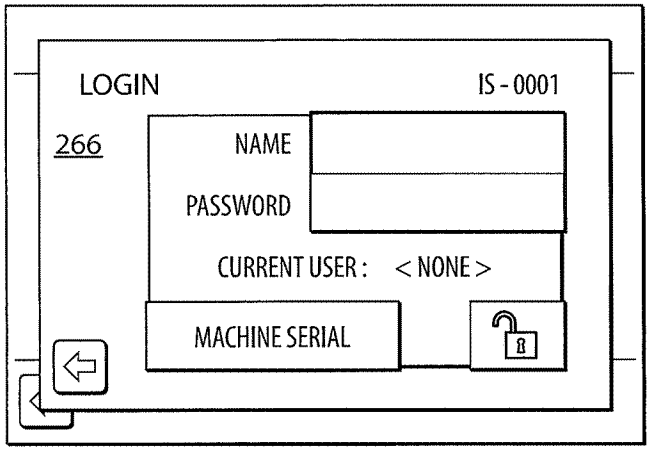
FIG. 55 shows a GUI of the log-in screen of FIG. 24.

In the instance that the operator when at the control panel screen 228, selects the "configuration" button, the operator is take to configuration screen 234 and presented with six buttons to select from; namely, a "set" button, a "language" button, a "screen configure" button, a "time set-up" button, a "units" button and a "machine serial" button. If the operator selects the "set point" button, then the operator is taken to the set point screen 254, better seen in FIG. 49. If the operator selects the "language" button then the operator is taken to the language screen 256, better seen in FIG. 50. If the operator selects the screen "configure" button then the operator is taken to the configure screen 258, better seen in FIG. 51. If the operator selects the "time set-up" button, then the operator is taken to the time setup screen 260, better seen in FIG. 52. If the operator selects the "units" button, then the operator is taken to the units screen 262, better seen in FIG. 53. If the operator selects the "machine serial" button, then the operator is taken to the machine serial screen 264, better seen in FIG. 54. Upon the operator selecting from the options available on the machine serial screen 264 the operator is taken to a log-in screen 266, better seen in FIG. 55, and is prompted for a name and password.

If from the home screen 214 the operator has selected the "run" button, the operator is taken to wash type screen 218, better seen in FIG. 29. The operator then has the choice to select from, without intending to be limiting, eight buttons; namely the "light" button, the "medium" button, the "heavy" button, the "extra-heavy" button, the "sewage" button, the "leathers" button, the "machine rinse" button, and the "PPE"

button. In the event that there has been an alarm, the operator also has the option to select the "reset alarms" button.

Figure 56:
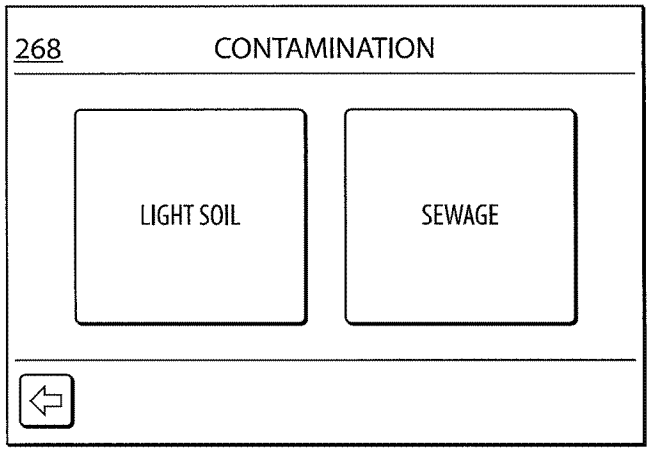
FIG. 56 shows a GUI of the leather contamination screen of FIG. 24.

If the operator selects the "leather" button, the operator is taken to the leather contamination screen 268, better seen in FIG. 56. In the leather contamination screen 268, the operator has the choice of a "light" soil button or a "sewage" button. Once the operator has selected whether the leather contamination is a light soil or sewage, the operator is taken to a machine load screen 276 described below.

Figure 57:
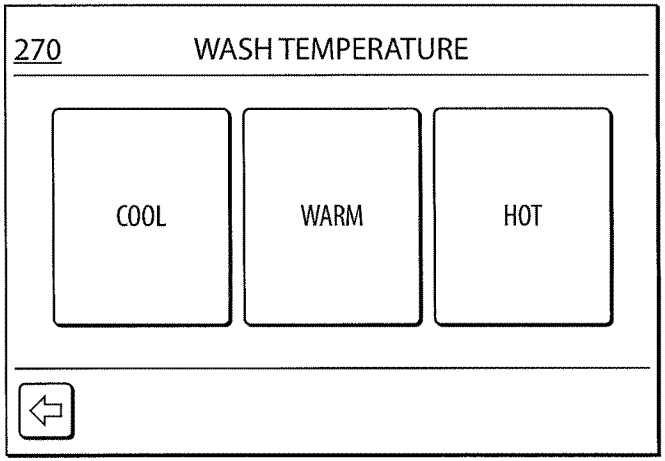
FIG. 57 shows a GUI of the wash temperature screen of FIG. 24.
Figure 58:
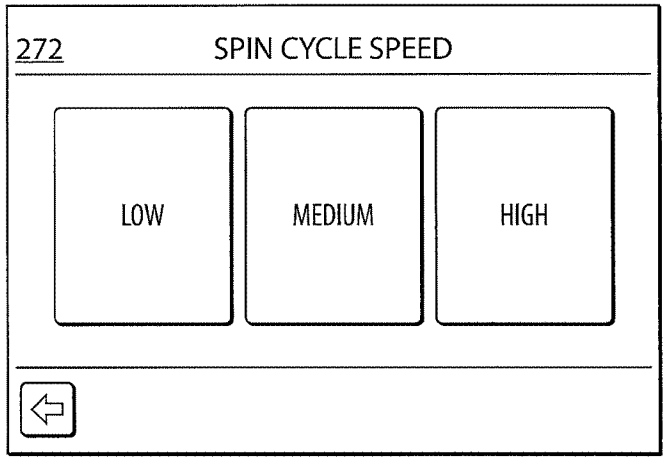
FIG. 58 shows a GUI of the spin cycle speed screen of FIG. 24.
Figure 59:
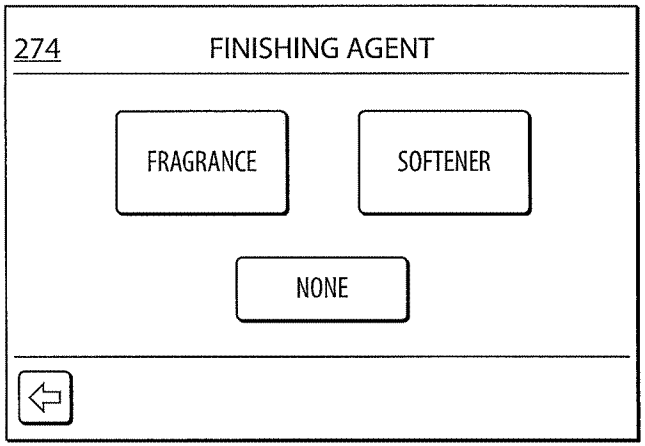
FIG. 59 shows a GUI of the finishing agent screen of FIG. 24.

In the event that the operator selects the "light", "medium", or "heavy" buttons in the wash type screen 218 then the operator is taken to the wash temperature screen 270 and presented with the choice of wash fluid temperatures by use of corresponding "cool", "warm" or "hot" buttons, as better seen in FIG. 57. Once the wash temperature has been selected, the operator is taken to spin cycle speed screen 272, better seen in FIG. 58 wherein the operator is given the choice of low, medium, and high spin cycle speeds which the operator selects by the corresponding buttons on the screen. Once the spin cycle speed has been selected, the operator is taken to the finishing agent screen 274 where the operator may select from a fragrance button, a softener button, or a "none" button which deselects the use of a finishing agent, as better seen in FIG. 59.

Figure 60:
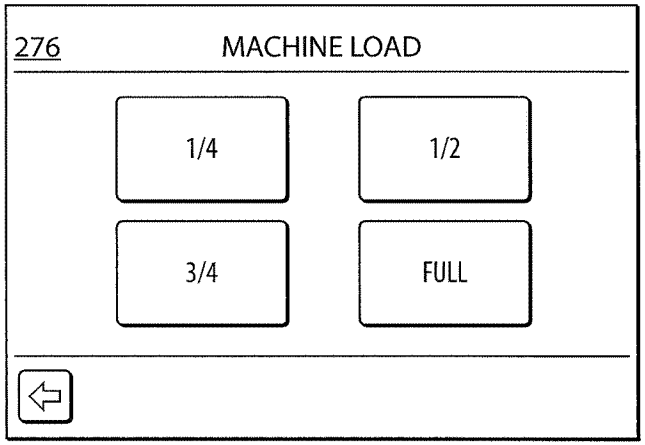
FIG. 60 shows a GUI of the machine load screen of FIG. 24.
Figure 61:
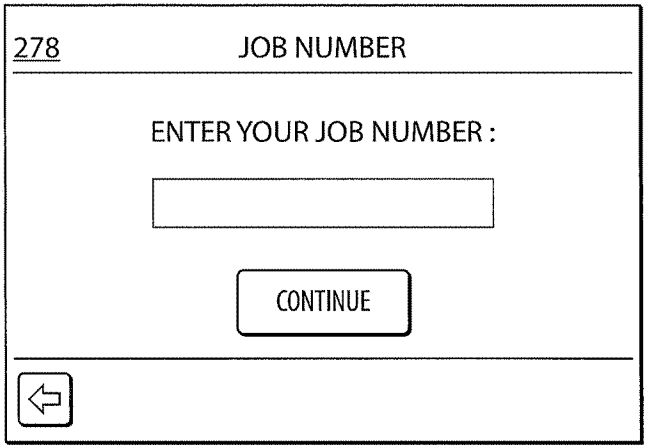
FIG. 61 shows a GUI of the job number screen of FIG. 24.
Figure 62:
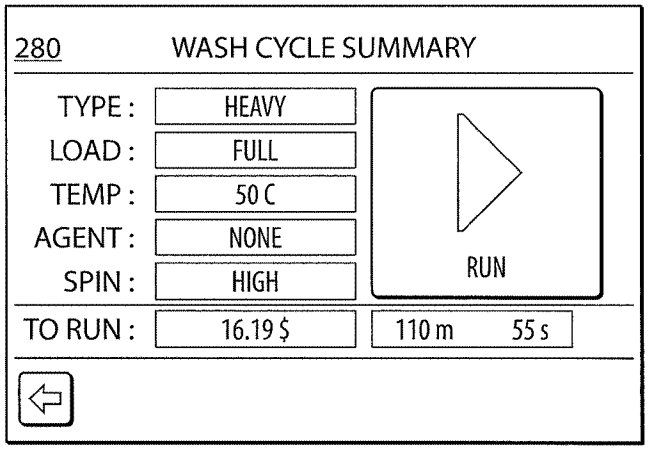
FIG. 62 shows a GUI of the wash cycle summary screen of FIG. 24.

Once the operator has selected the finishing agent (or no finishing agent), the operator is taken to the machine load screen 276, which is also the machine load screen that the operator is taken to upon selection of the leather contamination in leather contamination screen 268, as better seen in FIG. 60. In the machine load screen 276, the operator selects from either a "¼" button, a "½" button, a "¾" button or the "full" button, as better seen in FIG. 60, so as to select whether the volume of the items 16, which has been loaded into machine 10, are approximately ¼, ½, ¾ or full. For example, "full" means that, in one embodiment, 120 lbs of items 16 have been inserted into baskets 20 so as to symmetrically distribute the load around rotary drum 22. Once the operator has selected the machine load, the operator is taken to job number screen 278, better seen in FIG. 61, wherein the operator is prompted for the operator job number to be associated with that particular wash. Upon entry of the job number, and pushing the "continuing" button, the operator is taken to the wash cycle summary screen, better seen in FIG. 62.

In the wash cycle summary screen the operator is presented with a summary of the operator selections in teems of wash type, load size, wash temperature, finishing agent, and spin speeds. The selections made by the operator are matched by the wash processor to a corresponding recipe, for example as described below, and from that recipe the volume of the various consumables are determined and multiplied by the presently stored cost of each consumables, and those costs amount are summed and a total cost for the selected wash is presented in wash cycle summary screen 280 in the "to run" field. The predetermined run times for the various cycles associated with the selected wash are then also summed and the results in minutes and seconds are displayed adjacent to the cost field in the wash cycle summary screen. The operator is then prompted to initiate the selected wash cycle by a prominent "run" button located on the screen adjacent to the wash cycle summary information.

Figure 63:
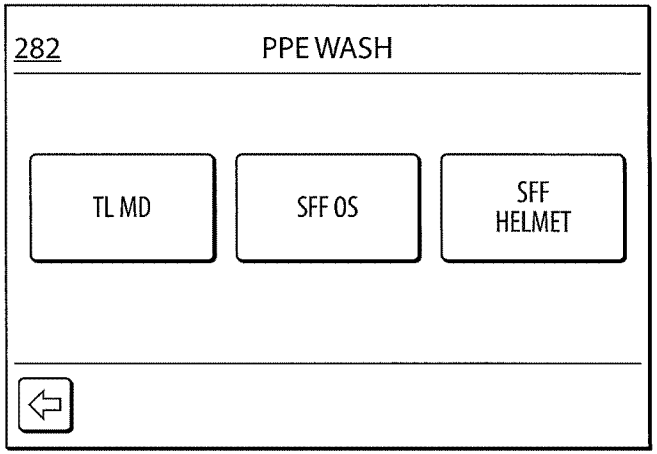
FIG. 63 shows a GUI of the PPE wash screen of FIG. 24.

If in the wash type screen 218 the operator has selected the "PPE" button, that is, the button associated with the washing Personal Protective Equipment, then the operator is taken to the PPE wash screen 282, better seen in FIG. 63. Within the PPE wash screen 282, the operator may select from various buttons corresponding to the type of PPE being washed, the example in FIG. 63 being given of a "TL MB" button (which stands for Thermal Liner Moisture Barrier), a "SFF OS" button (which stands for Structural Fire Fighter Outer Shell), and a "SFF helmet" button (which stands for Structural Fire Fighter helmet).

Figure 64:
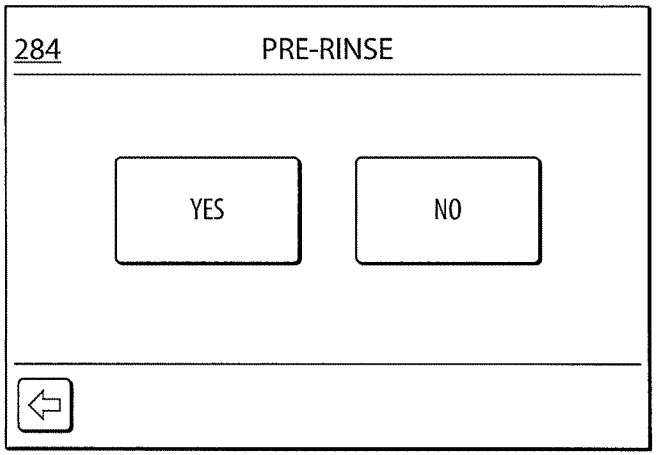
FIG. 64 shows a GUI of the pre-rinse screen of FIG. 24.

Once the operator selects the appropriate type of PPE to be washed by selecting the corresponding button on the PPE wash screen 228, the operator is taken to the pre-rinse screen 284, better seen in FIG. 64, wherein the operator is given the choice as to whether to use a wash pre-rinse by corresponding "yes" and "no" buttons. Once a pre-rinse has been selected or deselected, the operator is taken to machine load screen 276, and thereafter continues through job number screen 278, and wash cycle summary screen 280 as previously described.

Figure 65:
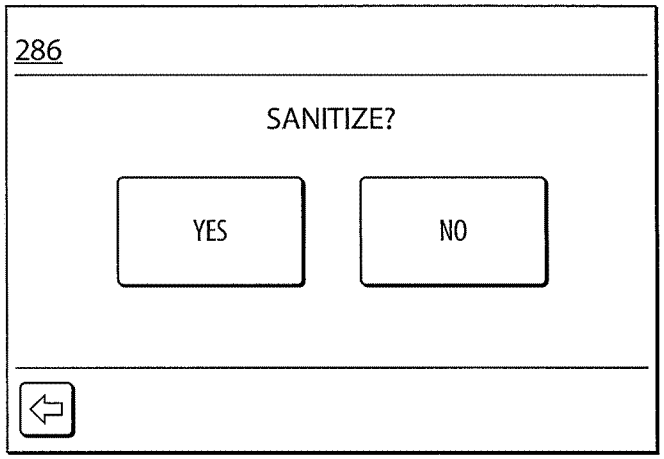
FIG. 65 shows a GUI of the sanitize screen of FIG. 24.

In the event that the operator has selected the "extra-heavy" or "sewage" buttons in wash type screen 218 then the operator is taken to the sanitize screen 286, better seen in FIG. 65 wherein the operator selects whether or not the operator wishes fluid sanitizer to be added to the wash load by selecting either the "yes" or "no" buttons. Once the operator has selected or deselected using sanitizer fluid, the operator is taken to job number screen 278, and thereafter taken to wash cycle summary screen 280 as described above.

Figure 66:
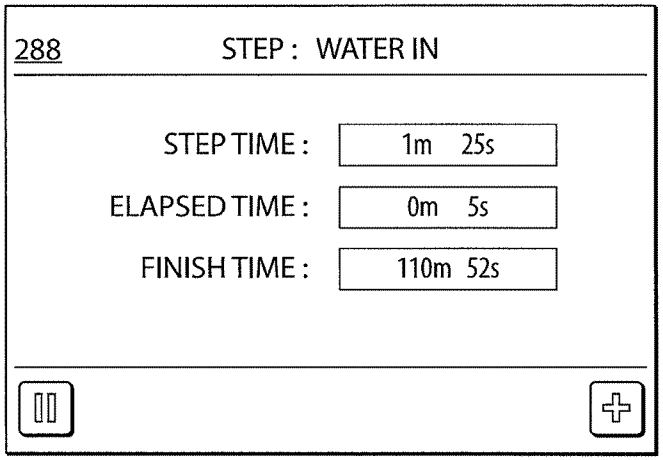
FIG. 66 shows a GUI of the water-in step screen of FIG. 24.
Figure 67:
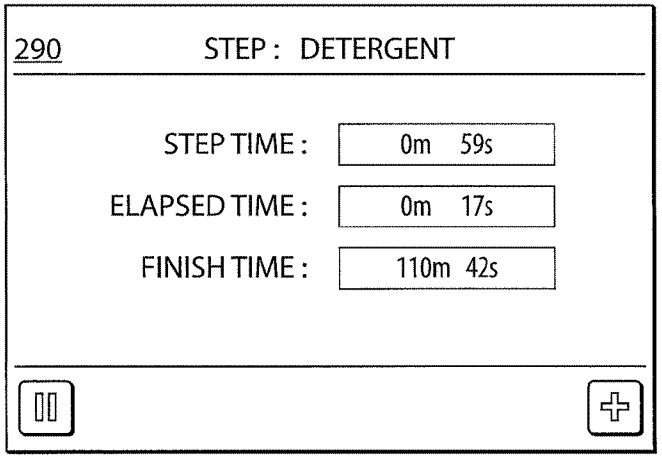
FIG. 67 shows a GUI of the detergent step screen of FIG. 24.
Figure 68:
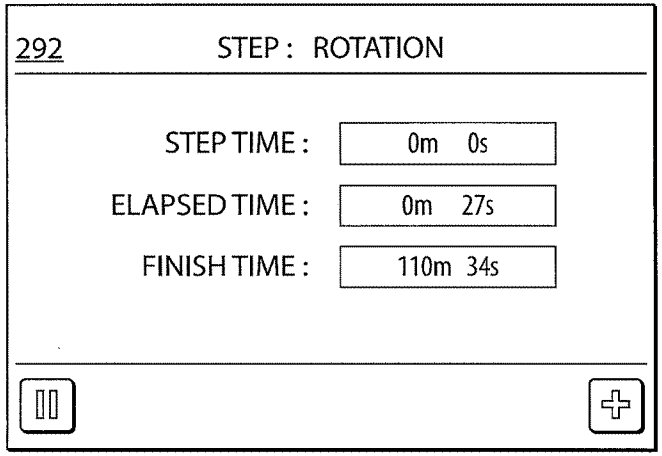
FIG. 68 shows a GUI of the rotation step screen of FIG. 24.
Figure 69:
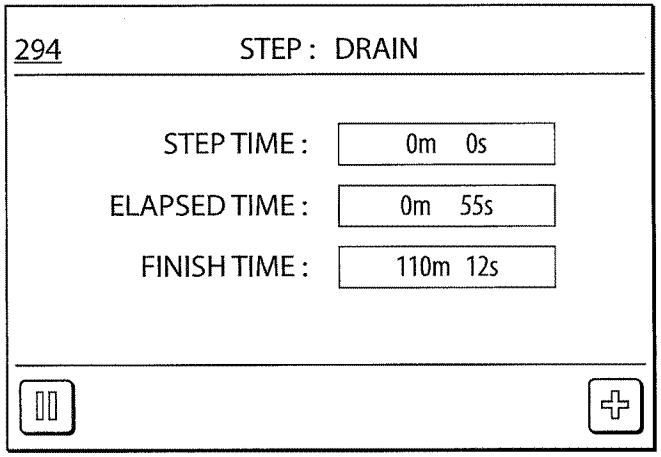
FIG. 69 shows a GUI of the drain step screen of FIG. 24.
Figure 70:
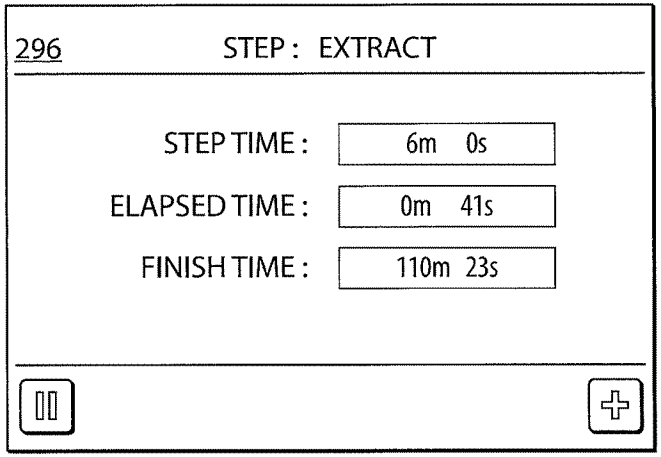
FIG. 70 shows a GUI of the extract step screen of FIG. 24.
Figure 71:
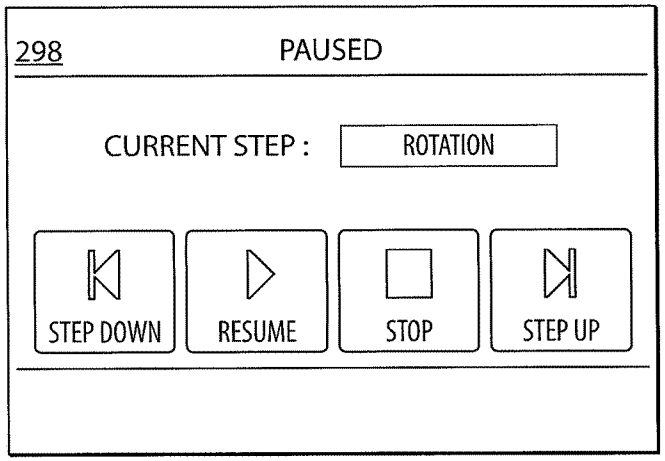
FIG. 71 shows a GUI of the pause screen of FIG. 24.

Once the operator is satisfied with the wash cycle that has been selected as displayed in wash cycle summary screen 280, and the operator then selects the "run" button on wash cycle summary screen 280, the operator is taken through a sequence of five "step" screens, namely; the water-in screen 288, better seen in FIG. 66, the detergent screen 290, better seen in FIG. 67, the rotation screen 292, better seen in FIG. 68, the drain screen 294 better seen in FIG. 69, and the extract screen 296 better seen in FIG. 70. Each of the step screens 288, 290, 292, 294, and 296, have in the lower left-hand corner, a "pause" button which takes the operator to the "paused" screen 298, better seen in FIG. 71.

Figure 72:
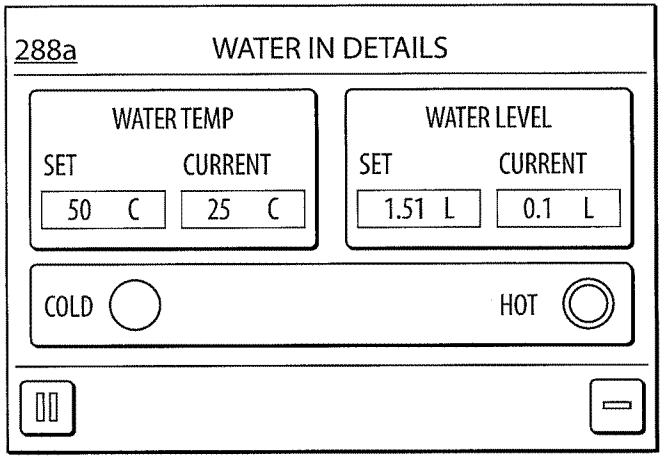
FIG. 72 shows a GUI of the water-in details screen of FIG. 24.
Figure 73:
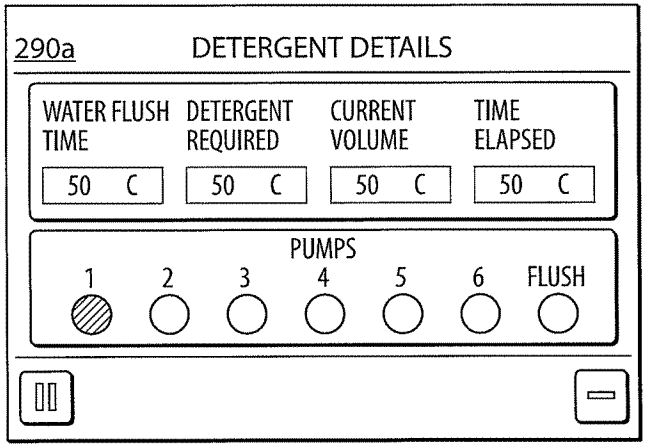
FIG. 73 shows a GUI of the detergent details screen of FIG. 24.
Figure 74:
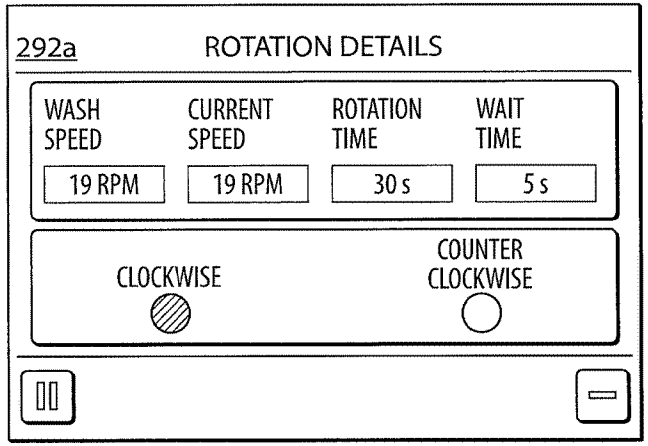
FIG. 74 shows a GUI of the rotation details screen of FIG. 24.
Figure 75:
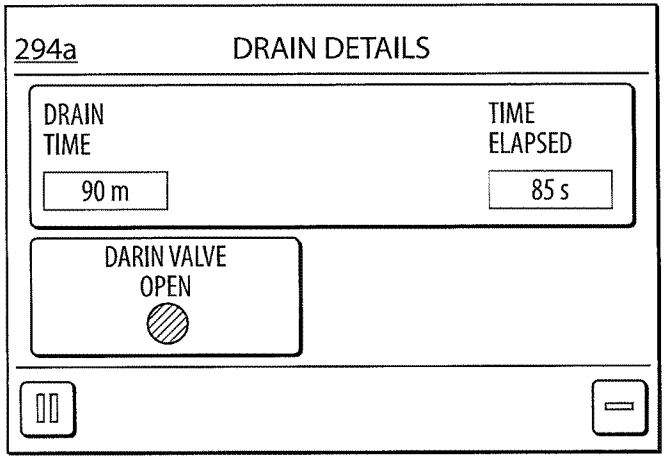
FIG. 75 shows a GUI of the drain details screen of FIG. 24.
Figure 76:
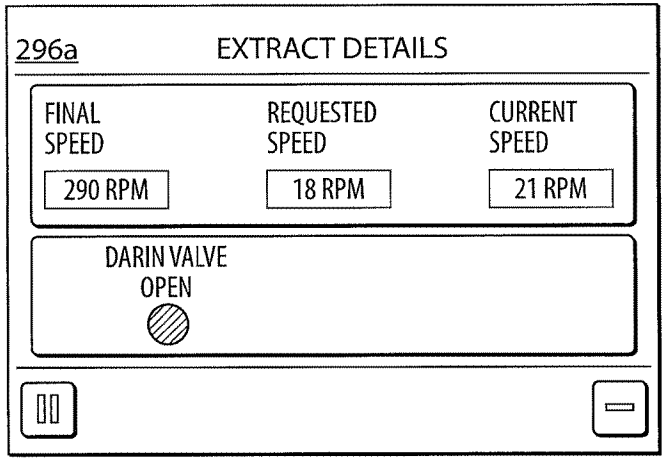
FIG. 76 shows a GUI of the extract details screen of FIG. 24.

Each of the five step screens 288, 290, 292, 294, and 296 also have a "+" button in the lower right-hand corner which, when selected, takes the operator to a corresponding "details" screen as seen in the corresponding "water-in" details screen **288*a* as seen in FIG. 72; a "detergent" details screen 290*a* as better seen in FIG. 73; a "rotation" details screen 292*a* as seen in FIG. 74; a "drain" details screen 294*a* as seen in FIG. 75, and an "extract" details screen 296*a* as seen in FIG. 76. As with the corresponding step screens, the details screen each have, in the lower left-hand corner a "pause" button which, again, takes the operator to the paused screen 298**. In the lower right-hand corner of the detail screen, a "−" button takes the "operator" back to the corresponding step screen.

Thus in operation, once an operator has selected the "run" button in the wash cycle summary screen 280, the selected displayed wash will cycle through the five step screens, showing the operation of the wash during each step in the corresponding step screen. Each step screen; whether it be the water step, the detergent step, the rotation step, the drain step, or the extract step, shows which steps is presently engaged and how far the machine is presently into that particular step. During the display of each of sequential steps screens, the operator may select to look at the corresponding details screen. Thus for example while the water-in screen 288 is displayed, the operator is told the length of time for that particular step, the elapsed time of the execution of that step and the predicted total time to finish all of the steps. If the operator selects the water-in detail screen **288*a* then, for example, the water temperature, both the set point desired for that step, and the current water temperature is displayed, and the water level, including the set point for that step, and the current water level is also displayed. Whether the water-in is hot or cold can also be displayed. By way of further example, if the operator selects the detergent details screen 290***a*, the following information may be displayed; the water flush time, the volume of detergent required the current volume of detergent which has been used during the present wash step, and the elapsed time of the detergent step. Also which may advantageously be displayed is a graphic representation as to which of the pumps are engaged. In the illustrated example six pumps are shown and one is indicated as activated (corresponding to which of the six Stages in the recipe is being pumped). If the pumps are being flushed then that status may be provided also.

In the rotation details screen 292*a*, the speed of rotation of rotary drum 22 within wash housing 30 is displayed, for example in the revolutions per minute (RPM). Thus, depending on the type of wash which was selected by the operator, the desired wash speed set point is displayed, the current rotation speed is displayed, the rotation time is displayed, and the wait times may also be displayed. Further, indicators may be provided to tell the operators whether the rotation is presently clockwise or counter-clockwise, as the cage may be rotate back and forth both clockwise and counter-clockwise to provide efficient agitation of items 16 through the wash fluids 32 contained in wash housing 30.

In the drain details screen 294*a*, the operator may be provided with the drain time's set point or estimated drain times, and also the presently elapsed time during the drain step. The operator may also be provided with an indication whether the drain valve is presently open or closed. In the extract details screen 296*a*, the operator may be provided the presently requested water extract RPM for rotation of rotary drum 22, the currently obtained RPM of the rotary drum and the final RPM speed of the rotary drum, which in the example illustrated, maybe as high as 209 RPM for final water extraction from item 16 when they are subjected to very high g-loadings within baskets 20. Again an indicator may be provided it to the operator as to whether the drain valve is open or not.

Figure 77:
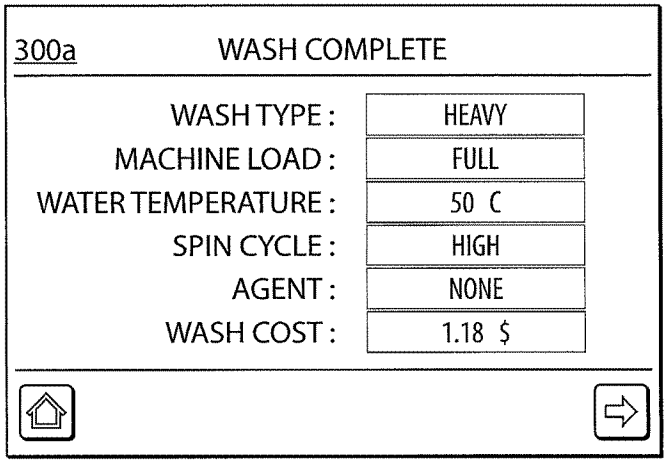
FIG. 77 shows a GUI of the wash-complete first screen of FIG. 24.
Figure 78:
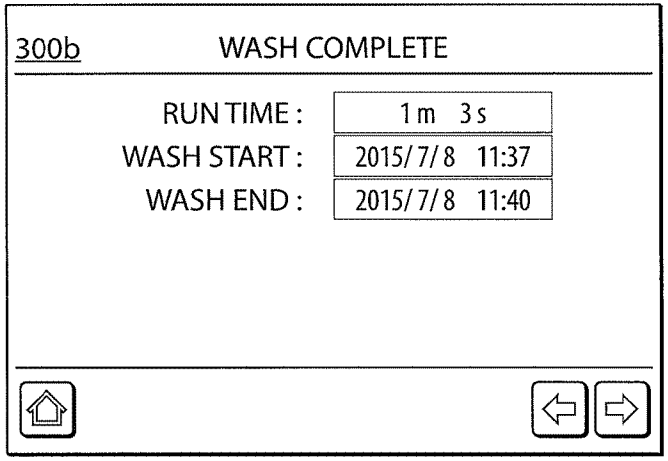
FIG. 78 shows a GUI of the wash-complete second screen of FIG. 24.
Figure 79:
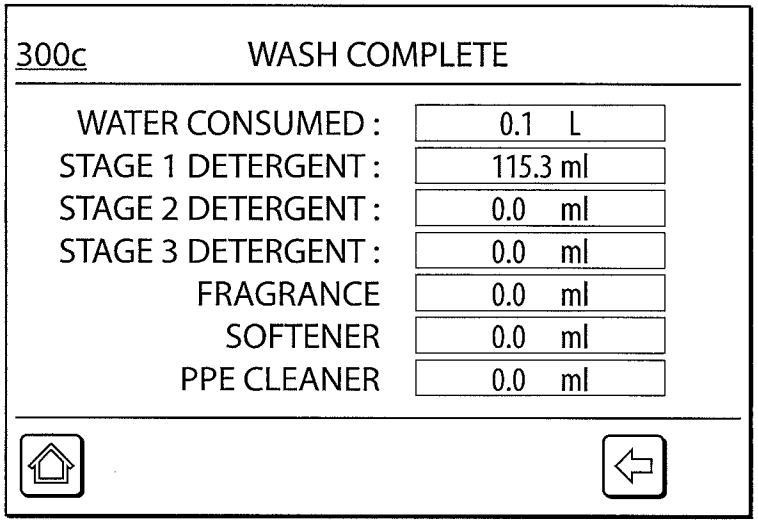
FIG. 79 shows a GUI of the wash-complete final screen of FIG. 24.

Once the five steps have been completed, a sequence of views entitled "wash-complete" are presented to the operator. In particular, by way of example, a wash complete first screen 300*a* better seen in FIG. 77 may summarize again the wash summary that was chosen by the operator; that is, so as to for example show the wash type, machine load, water temperature, spin cycle, agent and the wash cost. The wash complete first screen 300*a* may be followed in sequence by a wash complete second screen 300*b*, better seen by way of example in FIG. 78, wherein the wash run time is displayed, including the time of the wash start and the time of the wash end. The wash complete second screen 300*b* may be followed by the display of the wash complete final screen 300*c*, better seen by way of example in FIG. 79 wherein the amount of water consumed is displayed, the amount of Stage one detergent is displayed, the amount of Stage 2 detergent, if any, is displayed, the amount of Stage three detergent, if any, is displayed, the amount of fragrance, if any, is displayed, the amount of softener, if any, is displayed, and the amount of PPE cleaner, if any, is also displayed. A "home" button illustrated by a "house icon" button located in the lower left-hand corner of the wash complete screens may be selected by the operator to return the operator to the home screen 214.

Standard and PPE Wash Recipes

Table 5 lists thirteen washing recipes which are provided herein by way of example for use within the present system. Each recipe listed in Table 5 is set out in detail in corresponding Tables 5.01-5.13. Each of Tables 5.01-5.13 provide numbered steps which corresponds to a described action, a recipe group, a list of detailed headings, the corresponding variable amounts, and finally the amount of the anticipated time for that step. In the action column of each table the description of the action may be for example "water-in", which comprises the step of filling the wash housing to its predetermined level. "Classic Stage 1" refers to a first detergent which would be located in a first pail or other container associated with a first pump and flow lines into the wash housing. "Classic Stage 2", which may be a penetrator detergent, is located in a second pail or container associated with a second pump and its flow lines into the wash housing. A "Classic Stage 3" may be a force additive detergent located in a third pail or container having a third associated pump for pumping the third Stage detergent via dedicated flow lines into the wash housing. The described action in the action column may also include "rotation" for the relatively slow rotation of the rotary drum through the wash fluids according to the details listed in the detail column. The action in the action column may be "drained" for the draining of the wash fluids from the wash housing. A first wash and drain cycle may be followed by a rinse cycle wherein again the action column will include a water-in step, then, as called for, a softener or fragrance finishing agent, a rotation step, and then an extraction step. The extraction steps may include a first, medium speed rotational extraction, and a second, high-speed rotational extraction of the remaining water in items 16 held within baskets 20 within the rotary drum.

Where reference is made to Stage 4, in one embodiment that is a reference to fragrance fluids contained in a pail or other container which has its own associated pump and flow lines into the wash housing. Similarly Stage 5 may be softener fluids contained in a further pail or container and having an associated pump and flow lines into the wash housing. Stage 6 may refer to PPE cleaner contained in its own pail or other container and having its own associated pump and flow lines into the wash housing.

In certain recipes the variable amount may be chosen by the operator, for example in the water-in steps in the light, medium and heavy recipes (Tables 5.01-5.03 respectively). Where a variable may be varied by an operator the symbol "VV" is found in the variable column. In more control critical recipes such as the sewage recipe of Table 5.05, less control is given to the operator. For example, in the sewage recipe, the water in temperature is pre-set to 35° C. in step one, and 200° C. in Step 14.

Where the variable settings are not to be tampered with by the operator, for example the amounts of Stage 1 and 2, and in applicable instances, Stage 3 detergents, the volumes are pre-set as for example in the heavy recipe of Table 5.03. In the heavy recipe the Stage 1 detergent has a volume of 340 ml, the Stage 2 detergent has a volume of 480 ml and the Stage 3 detergent has a volume of 390 ml. As set out in the tables most of the variables are pre-set so as to meet the cleaning certification required to consistently obtain the food-grade-safe standard of cleanliness. Thus for example in the leathers recipe of Tables 5.06 and 5.07 the final extract speed which is operator variable in light washing is predetermined and pre-set at 196 rpm so as to generate very high g-loadings on items 16 held in the rotary drum. The amount of time for each step is also controlled so, that for example the high final extraction speed of 196 rpm called for in the leathers sewage recipe is only 10 minutes for the entire extraction step, whereas the extraction step, again at 196 rpm for the final extraction speed lasts 25 minutes for water extraction from a firefighter thermal liner moisture barrier as set out in Table 5.08.

Brief Description of the Tables

Table 1 lists items that may be washed in the present system, broken down by category type.

Table 2 is a data flow legend.

Table 3 is a device content legend.

Table 4 is a list of parts and corresponding reference numerals.

Table 5 lists of 14 recipes for standard PPE washing and listing the recipes by name and table.

Table 5.01 is for light washing.

Table 5.02 is for medium washing.

Table 5.03 is for heavy washing.

Table 5.04 is for extra heavy washing.

Table 5.05 is for sewage washing.

Table 5.06 is for leathers, light soil washing.

Table 5.07 is for leathers, sewage washing.

Table 5.08 is for washing firefighter thermal moisture barrier.

Table 5.09 is for washing firefighter thermal moister barrier with pre-rinse.

Table 5.10 is for washing firefighter outer shell.

Table 5.11 is for washing firefighter outer shell with pre-rinse.

Table 5.12 is for washing firefighter helmet.

Table 5.13 is for washing firefighter helmet with pre-rinse.

Table 5.14 is for a washing machine flush.

Table 6 is a brief description of Stage 1-3 detergents.

TABLE 1

Washable Items

| Category Type | Wash Items |
|---|---|
| Clothing and Apparel | Stuffed Animals |
| Footwear | Shoes, Boots, Sandals, Sports Shoes, Slippers, Ice Skates, in line skates |
| Toys | Stuffed Animals, Dolls |
| Sports | Baseball Hats, Hockey Gear, Football Gear All Sports Gear, Athletic Braces |
| Leathers | Wallets, Handbags, Purses, Backpacks, Briefcases, Tote Bags, Makeup bag, Pouch, Ouiltcd Bag, Duffle Bag, Cell Phone Holder, Belts, Garment Bag, Luggage |
| Life Jackets | All Types |
| Sleeping Bags | All Types |
| Survival Gear | All Types, All Marine Gear |
| Recreational Equipment | Any Protective Gear, All Scuba Gear, All Back-Country Gear, Umbrellas |
| Laundry | Wash &Fold |
| Outerwear | Jackets, Coats, Caps & Hats |
| Linens | Towels, Mats |
| Bedding | Pillows, Blankets, Comforters, Sheets |
| Outdoor | Cushions, BBO Covers, Small Tents, Boating, Cushions, Small Sails |
| Personal Protective Equipment (PPE) | Fire Gear, Proximity Gear, Boots, Helmets, Gas Masks, Bulle tProof Vests |
| Military | IOTV's, All Military Protective Clothing, Tank Explosive Blankets, Backpacks and External Gear, Canteens, Helmets, Boots, Shoes |

TABLE 2

Data Flow Legend

| Reference No. | Description |
|---|---|
| 104 | <--------> Two way communication link that allows administrator to remotely monitor machine activity, perform machine diagnostics, install program updates and turn the machine off/on If necessary. |
| 106 | <——> Two way communication link between administrator employee(s) (i.e. Machine Technician, Cleaning Technician) and the remote Customer via direct instant Message, Voice Call, and Video Voice Call. |
| 108 | <´´´´´´> Two way communication link that allows the remote Customer to view and report their specific Wash System Machine Analytics (i.e.#Wash Loads, Detergent Usage, Cost Per Wash Load,# of Washes by Insurance Company, etc.) from any Internet Browser through a secure administrator Machine Web User Interface (UI). |
| 112 | <+++++> One way communication that sends Machine Analytic data (i.e. date, time, wash load#, detergents use in ml, water temp, water usage in ml, etc.) via email in .csv file format to administrator email server which Is then arsed and deposited into administrator MySQL database. |
| 116 | <• • • • > Two way communication link that allows an administrator employee to view, add, delete administrator Wash System Machine(s) Analytics (i.e.#of Wash Loads, Detergent Usage, Cost Per Wash Load, #of Washes by Insurance Company, etc.) from any Internet Browser through a secure Machine Web User Interface. |
| 118 | <x - - - x> Two way communication link that allows administrator to remotely view, edit, 'add, delete and report the analytic data generated by each Customer Wash System and also view, edit, add and delete the content (i.e. FAQ's, Training Videos, Maintenance Video, etc.) accessed by the Customer through either the Machine Tablet or any Browser enabled device. |
| 122 | <~~~~~> Two way communication the provides touch screen operated Instructions from the HMI (Human Machine Interface) to the PLC (Programmable Logic Controller) which operates the componentry of the machine (i.e. run/stop motor, open/close drain valve, open/close chemical pumps, etc.). |

TABLE 3

Device Content Legend

| Reference No. | Icon | Description |
|---|---|---|
| 120 | Tablet | Skype: Instant Message, Voice Call, and Video Voice Call Machine Maintenance/ Cleaning/Training Support App Locker, Auto Start App, Volume Control App, Esporta App: FAO's, ecommerce access, training videos |
| 126 | PLC | Software written through SoMachine software |
| 124 | HMI | Touchscreen interface designed though Viico Designer software |
| 144 | WIFI ROUTER | Provides Internet to Tablet via Wi-Fi signal |
| 146 | EWON | Industrial Virtual Private Network that allows remote connectivity to a washing machine from any Internet access location |
| 134 | ECATCHER SOFTWARE | An interface software allowing administrator employees to remotely monitor, perform machine diagnostics, install program updates, and turn off machine if necessary |
| 138 | TALK2M SERVER | Store all of the Washing Machine Remote Access accounts |
| 110 | ESPORTA WEB USER INTER-FACE | Allows a Customer to view and add machine analytics and an administrator Employee to view, add, edit, and delete machine analytics |

TABLE 3-continued

| Device Content Legend | | |
|---|---|---|
| Reference No. | Icon | Description |
| 128 | EMAIL SERVER | Stores machine analytics emails (.csv attachments) from each machine which are submitted every 24 hours or on request |
| 132 | WEB SERVER | Contains administrator App and Web App content (i.e. training videos, FAO's, User Mgmt Module, Content Management Module, User Permission Module, News Mgmt Module, Analytic User Interface Module) |
| 114 | DATABASE | MySQL database which is located on the Esporta Web Server that stores all Esporta App and Web App data fields and all Machine Analytic data from reporting machines in the filed |
| 126 (a) | PLC SOFTWARE | SoMachinc Software which allows an Esporta Employee to program the PLC |
| 124 (a) | HMI SOFTWARE | Vijeo Designer Software which allows an Esporta Employee to program the HMI |

TABLE 4

| List of Reference Numerals | |
|---|---|
| Number | Description |
| 10 | Washing Machine |
| 10 (a) | Front Housing |
| 12 | Door |
| 12 (a) | Hinge |
| 14 | Cage Door |
| 14 (a) | Locking Pins |
| 16 | Items to be restored |
| 16 (a) | Shoes |
| 16 (b) | Leather Goods |
| 16 (c) | Stuffed Toys |
| 18 | Opening |
| 20 | Basket |
| 20 (a) | Apertures |
| 20 (b) | Sidewalls |
| 22 | Rotary Drum |
| 24 | Cage Segment |
| 26 | Drive Axle |
| 28 | Front Support Structure |
| 30 | Wash Housing |
| 32 | Washing Fluid |
| 100 | Remote Locations (in oval) |
| 102 | Administrator |
| 104 | Dashed dataflow line |
| 106 | Solid Data Flow Line |
| 108 | Hash Symbol Data Flow Line |
| 110 | Administrator Machine WebUI |
| 112 | "+" Symbol Data Flow Line |
| 114 | Database |
| 116 | "dots" Symbol Data Flow Line |
| 118 | "X" Symbo Data Flow Line |
| 120 | Machine Tablet |
| 122 | Corrugated Data Flow Line |
| 124 | HMI |
| 124 (a) | Software |
| 126 | PLC |
| 126 (a) | Software |
| 128 | Email Server |
| 130 | Internet |
| 132 | Web server |
| 134 | eCatcher Software |
| 136 | PC |
| 138 | Talk2M Server |
| 140 | Firewall |
| 142 | Internet Browser |
| 144 | Wi-Fi Router |
| 146 | EWON Router |
| 210 | Screen System Initializing |
| 212 | Enter Screen |

TABLE 4-continued

| List of Reference Numerals | |
|---|---|
| Number | Description |
| 214 | Home Screen |
| 216 | Route Cage Screen |
| 218 | Wash Type Screen |
| 220 | Alarms Screen |
| 222 | Emergency Stop Info Screen |
| 224 | Alarms Active Screen |
| 226 | Internet Connection Error Screen |
| 226 (a) | 2nd Internet Connection Error Screen |
| 226 (b) | 3rd Internet Connection Error Screen |
| 228 | Control Panel Screen |
| 230 | Machine Info Screen |
| 232 | Maintenance Screen |
| 234 | Configuration Screen |
| 236 | Hour Meter Screen |
| 238 | Water Meter Screen |
| 240 | Wash Cvclc Counter Screen |
| 242 | Detergent Inventory Screen |
| 244 | Set Pail Volume Screen |
| 246 | Water Valve Test Screen |
| 248 | Drain Valve Test |
| 250 | Pump Calibration Screen |
| 252 | Water Level and Drain Check Screen |
| 254 | Set Point Screen |
| 256 | Language Screen |
| 258 | "Screen Configure" Screen |

TABLE 5

| Standard & PPE Wash Recipes | | |
|---|---|---|
| No. | Recipe Name | TIME |
| 01 | LIGHT | 67 MIN + 2 FILLS |
| 02 | MEDIUM | 75 MIN + 3 FILLS |
| 03 | HEAVY | 101 MIN + 4 FILLS |
| 04 | EXTRA HEAVY | 134 MIN + 5 FILLS |
| 05 | SEWAGE | 114 MIN + 5 FILLS |
| 06 | LEATHERS LIGHT SOIL | 43 MIN + 2 FILLS |
| 07 | LEATHERS SEWAGE | 42 MIN + 3 FILLS |
| 08 | FIREFIGHTER THERMAL LINER MOISTURE BARRIER | 64 MIN + 3 FILLS |
| 09 | FIREFIGHTER THERMAL LINER MOISTURE BARRIER W/PRE RINSE | 81 MIN + 5 FILLS |
| 10 | FIREFIGHTER OUTER SHELL | 66 MIN + 4 FILLS |
| 11 | FIREFIGHTER OUTER SHELL W/PRE RINSE | 81 MIN + 5 FILLS |
| 12 | FIREFIGHTER HELMET | 69 MIN + 5 FILLS |
| 13 | FIREFIGHTER HELMET WPRE RINSE | 76 MIN + 6 FILLS |
| 14 | MACHINE FLUSH | 14 MIN + 1 FILL |

TABLE 5.01

| LIGHT | | | | | |
|---|---|---|---|---|---|
| Step | Action | Recipe Group | Detail | Variable | Time |
| CYCLE #1 - Wash drain | | | | | |
| 1 | Water In 201 | 2 | Process # | 1 | 1 FILL |
| | | | Temp | V V | |
| | | | To Get | V V | |
| 2 | CLASSIC STAGE 1 (TAK 1 Detergent) 301 | 3 | Process # | 1 | 2 MIN |
| | | | Pump # | 1 | |
| | | | Volume | 340 | |
| | | | Flush Time | 20 | |

TABLE 5.01-continued

| LIGHT | | | | | |
|---|---|---|---|---|---|
| Step | Action | Recipe Group | Detail | Variable | Time |
| 3 | CLASSIC STAGE 2 (Penetrator Detergent) 302 | 3 | Process # | 2 | 2 MIN |
| | | | Pump # | 2 | |
| | | | Volume | 340 | |
| | | | Flush Time | 20 | |
| 4 | Rotation 408 | 1 | Process # | 8 | 30 MIN |
| | | | RPM | 19 | |
| | | | Run Time | 30 | |
| | | | Rotate Time | 30 | |
| | | | Pause Time | 5 | |
| 5 | Drain 501 | 5 | Process # | 1 | 1 MIN |
| | | | Time | 1 | |
| CYCLE #2 - Rinse with Finishing | | | | | |
| 6 | Water In 201 | 2 | Process # | 1 | 1 FILL |
| | | | Temp | V V | |
| | | | To Get | V V | |
| 7 | NONE Softener Fragrance 303 (Finishing Agent) | 3 | Process # | 3 | 2 MIN |
| | | | Pump # | V V | |
| | | | Volume | 340 | |
| | | | Flush Time | 20 | |
| 8 | Rotation 407 | 1 | Process # | 7 | 15 MIN |
| | | | RPM | 19 | |
| | | | Run Time | 15 | |
| | | | Rotate Time | 30 | |
| | | | Pause Time | 5 | |
| 9 | Extract 603 | 6 | Process # | 3 | 15 MIN |
| | | | Extract Time | 15 | |
| | | | Extract Drain RPM | 19 | |
| | | | First Speed | 54 | |
| | | | Second Speed | 81 | |
| | | | Final Speed | V V | |

TOTAL TIME: 67 MIN + 2 FILLS

NOTE: Light Soil recipes contain no Stage 3 Force Additive and therefore present no disinfecting abilities. This recipe should only he used for extremely lightly soiled contents.

TABLE 5.02

| MEDIUM | | | | | |
|---|---|---|---|---|---|
| Step | Action | Recipe Group | Detail | Variable | Time |
| CYCLE #1 - Wash | | | | | |
| I | Water In 201 | 2 | Process # | 1 | 1 FILL |
| | | | Temp | V V | |
| | | | To Get | V V | |
| 2 | CLASSIC STAGE 1 (TAK 1 Detergent) 301 | 3 | Process # | 1 | 2 MIN |
| | | | Pump # | 1 | |
| | | | Volume | 340 | |
| | | | Flush Time | 20 | |
| 3 | CLASSIC STAGE 2 (Penetrator Detergent) 306 | 3 | Process # | 6 | 2 MIN |
| | | | Pump # | 2 | |
| | | | Volume | 480 | |
| | | | Flush Time | 20 | |
| 4 | Rotation 404 | 4 | Process # | 4 | 30 MIN |
| | | | RPM | 19 | |
| | | | Run Time | 30 | |
| | | | Rotate Time | 30 | |
| | | | Pause Time | 5 | |
| 5 | Extract 601 | 6 | Process # | 1 | 6 MIN |
| | | | Extract time | 6 | |
| | | | Extract Drain RPM | 19 | |
| | | | 1st speed | 54 | |
| | | | 2nd speed | 81 | |
| | | | Final Speed | V V | |

TABLE 5.02-continued

| MEDIUM | | | | | |
|---|---|---|---|---|---|
| Step | Action | Recipe Group | Detail | Variable | Time |
| CYCLE #2 - Sanitize | | | | | |
| 6 | Water In 201 | 2 | Process # | 1 | 1 FILL |
| | | | Temp | V V | |
| | | | To Get | V V | |
| 7 | CLASSIC STAGE 3 (Force Additive) 305 | 3 | Process # | 5 | 2 MIN |
| | | | PuniD # | 3 | |
| | | | Volume | 390 | |
| | | | Flush Time | 10 | |
| 8 | Rotation 402 | i | Process # | 2 | 10 MIN |
| | | | RPM | 19 | |
| | | | Run Time | 10 | |
| | | | Rotate Time | 30 | |
| | | | Pause Time | 5 | |
| 9 | Drain 501 | s | Process # | 1 | 1 MIN |
| | | | Time | | |
| CYCLE #3 - Rinse with Finishing | | | | | |
| 10 | Water In 201 | 2 | Process # | 1 | 1 FILL |
| | | | Temp | V V | |
| | | | To Get | V V | |
| 11 | NONE SOFTENER FRAGRANCE 303 (Finishine Acent) | 3 | Process # | 3 | 2 MIN |
| | | | Pump # | V V | |
| | | | Volume | 340 | |
| | | | Flush Time | 20 | |
| 12 | Rotation 401 | 4 | Process # | 1 | 5 MIN |
| | | | RPM | 19 | |
| | | | Run Time | 5 | |
| | | | Rotate Time | 30 | |
| | | | Pause Time | 5 | |
| 11 | Extract 603 | 6 | Process # | 3 | 15 MIN |
| | | | Extract Time | 15 | |
| | | | Extract Drain RPM | 19 | |
| | | | First Speed | 54 | |
| | | | Second Speed | 81 | |
| | | | Final Speed | V V | |

TOTAL TIME 75 MIN + 3 FILLS

TABLE 5.03

| HEAVY | | | | | |
|---|---|---|---|---|---|
| Step | Action | Recipe Group | Detail | Variable | Time |
| CYCLE #1 - Wash | | | | | |
| 1 | Water In 201 | 2 | Process # | 1 | 1 FILL |
| | | | Temp | V V | |
| | | | To Get | V V | |
| 2 | CLASSIC STAGE 1 (TAK 1 Detergent) 301 | 3 | Process # | 1 | 2 MIN |
| | | | Pump # | 1 | |
| | | | Volume | 340 | |
| | | | Flush Time | 20 | |
| 3 | CLASSIC STAGE 2 (Penetrator Detergent 306) | 3 | Process # | 6 | 2 MIN |
| | | | Pump # | 2 | |
| | | | Volume | 480 | |
| | | | Flush Time | 20 | |
| 4 | Rotation 410 | 4 | Process # | 10 | 40 MIN |
| | | | RPM | 19 | |
| | | | Run Time | 40 | |
| | | | Rotate Time | 30 | |
| | | | Pause Time | 5 | |
| 5 | Extract 601 | 6 | Process # | 1 | 6 MIN |
| | | | Extract time | 6 | |
| | | | Extract Drain RPM | 19 | |
| | | | 1st speed | 54 | |
| | | | 2nd speed | 81 | |
| | | | Final Speed | V V | |

TABLE 5.03-continued

| Step | Action | HEAVY Recipe Group | Detail | Variable | Time |
|---|---|---|---|---|---|
| | | CYCLE #2 - Rinse #l | | | |
| 6 | Water In 201 | 2 | Process # | 1 | 1 FILL |
| | | | Temp | V V | |
| | | | To Get | V V | |
| 7 | Rotation 402 | 4 | Process # | 2 | 10 MIN |
| | | | RPM | 19 | |
| | | | Run Time | 10 | |
| | | | Rotate Time | 30 | |
| | | | Pause Time | 5 | |
| 8 | Drain 501 | 5 | Process # | 1 | 1 MIN |
| | | | Time | 1 | |
| | | CYCLE #3 - Sanitize | | | |
| 9 | Water In 201 | 2 | Process # | l | 1 FILL |
| | | | Temp | V V | |
| | | | To Get | V V | |
| | | | 1 for mix | 5 | |
| 10 | CLASSIC STAGE 3 (Force Additive) 305 | 3 | Process # | 3 | 2 MIN |
| | | | Pumn # | 390 | |
| | | | Volume | | |
| | | | Flush Time | 10 | |
| li | Rotation 402 | 4 | Process # | 210 | 10 MIN |
| | | | RPM | 19 | |
| | | | Run Time | | |
| | | | Rotate Time | 30 5 | |
| | | | Pause Time | | |
| 12 | Drain 501 | | Process # | 1 | 1 MIN |
| | | | Time | 1 | |
| | | CYCLE #4 - Rinse #2 with Finishing | | | |
| 11 | Water In 201 | 2 | Process # | 1 | 1 FILL |
| | | | Temp | V V | |
| | | | To Get | V V | |
| 14 | NONE SOFTENER FRAGRANCE 303 (Finishing Agent) | 3 | Process # | 3 | 2 MIN |
| | | | Pump # | V V | |
| | | | Volume | 340 | |
| | | | Flush Time | 10 | |
| 15 | Rotation 402 | 4 | Process # | 2 | 10 MIN |
| | | | RPM | 19 | |
| | | | Run Time | 10 | |
| | | | Rotate Time | 30 | |
| | | | Pause Time | 5 | |
| 16 | Extract 603 | 6 | Process # | 3 | 15 MIN |
| | | | Extract Time | 11 | |
| | | | Extract | 19 | |
| | | | Drain RPM | | |
| | | | First Speed | 54 | |
| | | | Second Speed | 81 | |
| | | | Final Speed | V V | |

TOTAL TIME 101 MIN + 4 FILLS

TABLE 5.04

| Step | Action | EXTRA HEAVY Recipe Group | Detail | Variable | Time |
|---|---|---|---|---|---|
| | | CYCLE #1 - Wash #1 | | | |
| 1 | Water In 201 | 2 | Process # | 1 | 1 FILL |
| | | | Temp | V V | |
| | | | To Get | V V | |
| 2 | CLASSIC STAGE 2 (Penetrator Detergent) 306 | 3 | Process # | 6 | 2 MIN |
| | | | Pump # | 2 | |
| | | | Volume | 480 | |
| | | | Flush Time | 20 | |
| 3 | Rotation 404 | 4 | Process # | 4 | 30 MIN |
| | | | RPM | 19 | |
| | | | Run Time | 30 | |
| | | | Rotate Time | 30 | |
| | | | Pause Time | 5 | |

TABLE 5.04-continued

| Step | Action | EXTRA HEAVY Recipe Group | Detail | Variable | Time |
|---|---|---|---|---|---|
| 4 | Drain 501 | 5 | Process # | 1 | 1 MIN |
| | | | Time | 1 | |
| | | CYCLE #2 - Wash #2 | | | |
| 5 | Water In 201 | 2 | Process # | 1 | 1 FILL |
| | | | Temp | V V | |
| | | | To Get | V V | |
| 6 | CLASSIC STAGE 1 (TAK 1 Detergent) 301 | 3 | Process # | 1 | 2 MIN |
| | | | Pump # | 1 | |
| | | | Volume | 340 | |
| | | | Flush Time | 20 | |
| 7 | CLASSIC STAGE 2 Penetrator Detergent) 302 | 3 | Process # | 2 | 2 MIN |
| | | | Pump # | 2 | |
| | | | Volume | 340 | |
| | | | Rush Time | 20 | |
| 8 | Rotation 410 | 4 | Process # | 10 | 40 MIN |
| | | | RPM | 19 | |
| | | | Run Time | 40 | |
| | | | Rotate Time | 30 | |
| | | | Pause Time | 5 | |
| 9 | Extract 601 | 6 | Process # | 1 | 6 MIN |
| | | | Extract time | 6 | |
| | | | Extract | 19 | |
| | | | Drain RPM | | |
| | | | 1st speed | 54 | |
| | | | 2nd speed | 81 | |
| | | | Final Speed | V V | |
| | | CYCLE #3 - Rinse #1 | | | |
| 10 | Water In 201 | 2 | Process # | 1 | 1 FILL |
| | | | Temp | V V | |
| | | | To Get | V V | |
| JI | Rotation 402 | 4 | Process # | 2 | 10MIN |
| | | | RPM | 19 | |
| | | | Run Time | 10 | |
| | | | Rotate Time | 30 | |
| | | | Pause Time | 5 | |
| 12 | Drain 501 | 5 | Process # | 1 | 1 MIN |
| | | | Time | 1 | |
| | | CYCLE #4 - Sanitize | | | |
| il | Water In 201 | 2 | Process # | 1 | 1 FILL |
| | | | Temp | V V | |
| | | | To Get | V V | |
| 14 | CLASSIC STAGE 3 (Force Additive) 305 | 3 | Process # | 5 | 2 MIN |
| | | | Pump # | 3 | |
| | | | Volume | 390 | |
| | | | Flush Time | 20 | |
| 15 | Rotation 402 | 4 | Process # | 2 | 10 MIN |
| | | | RPM | 19 | |
| | | | Run Time | 10 | |
| | | | Rotate Time | 30 | |
| | | | Pause Time | 5 | |
| 16 | Drain 501 | 5 | Process # | 1 | 1 MIN |
| | | | Time | 1 | |
| | | CYCLE #5 - Rinse #2 with Finishing | | | |
| 12 | Water In 201 | 2 | Process # | 1 | 1 FILL |
| | | | Temp | V V V V | |
| | | | To Get | | |
| 18 | NONE SOFTENER FRAGRANCE 303 (Finishing Agent) | 3 | Process # | 3 | 2 MIN |
| | | | Pump # | V V | |
| | | | Volume | 340 | |
| | | | Flush Time | 20 | |
| 12 | Rotation 402 | 4 | Process # | 2 | 10 MIN |
| | | | RPM | 19 | |
| | | | Run Time | 10 | |
| | | | Rotate Time | 30 | |
| | | | Pause Time | 5 | |
| 20 | Extract 603 | 6 | Process # | 3 | 15 MIN |
| | | | Extract Time | 15 | |
| | | | Extract | 19 | |

TABLE 5.04-continued

| EXTRA HEAVY | | | | | |
|---|---|---|---|---|---|
| Step | Action | Recipe Group | Detail | Variable | Time |
| | | | Drain RPM | | |
| | | | First Speed | 54 | |
| | | | Second Speed | 81 | |
| | | | Final Speed | V V | |

TOTAL TIME 134 MIN + FILLS

TABLE 5.05

| SEWAGE | | | | | |
|---|---|---|---|---|---|
| Step | Action | Recipe Group | Detail | Variable | Time |
| CYCLE #1 - Wash #1 | | | | | |
| 1 | Water In 202 | 2 | Process # | 2 | 1 FILL |
| | | | Temp | 35 | |
| | | | To Get | V V | |
| 2 | CLASSIC STAGE 2 (Penetrator Detergent) 306 | 3 | Process # | 6 | 2 MIN |
| | | | Pump # | 2 | |
| | | | Volume | 480 | |
| | | | Flush Time | 20 | |
| 3 | Rotation 402 | 4 | Process # | 2 | 10 MIN |
| | | | RPM | 19 | |
| | | | Run Time | 10 | |
| | | | Rotate Time | 30 | |
| | | | Pause Time | 5 | |
| 4 | Drain 501 | 5 | Process # | 1 | 1 MIN |
| | | | Time | 1 | |
| CYCLE #2 - Wash #2 | | | | | |
| 5 | Water In 202 | 2 | Process # | 2 | 1 FILL |
| | | | Temp | 35 | |
| | | | To Gel | V V | |
| 6 | CLASSIC STAGE 1 (TAK 1 Detergent) 301 | 3 | Process # | 1 | 2 MIN |
| | | | Pump # | 1 | |
| | | | Volume | 340 | |
| | | | Flush Time | 20 | |
| 7 | CLASSIC STAGE 2 (Penetrator Detergent) 302 | 3 | Process # | 2 | 2 MIN |
| | | | Pump # | 2 | |
| | | | Volume | 340 | |
| | | | Flush Time | 20 | |
| B | Rotation 410 | i | Process # | 10 | 40 MIN |
| | | | RPM | 19 | |
| | | | Run Time | 40 | |
| | | | Rotate Time | 30 | |
| | | | Pause Time | 5 | |
| 9 | Extract 601 | 6 | Process # | 1 | 6 MIN |
| | | | Extract time | 6 | |
| | | | Extract | 19 | |
| | | | Drain RPM | | |
| | | | 1 st speed | 54 | |
| | | | 2nd speed | 81 | |
| | | | Final Speed | V V | |
| CYCLE #3 - Sanitize | | | | | |
| 10 | Water In 202 | 2 | Process # | 2 | 1 FILL |
| | | | Temp | 35 | |
| | | | To Get | V V | |
| 11 | CLASSIC STAGE 3 (Force Additive) 305 | 3 | Process # | 5 | 2 MIN |
| | | | Pumn # | 3 | |
| | | | Volume | 390 | |
| | | | Flush Time | 20 | |
| 12 | Rotation 402 | 4 | Process # | 2 | 10 MIN |
| | | | RPM | 19 | |
| | | | Run Time | 10 | |
| | | | Rotate Time | 30 | |
| | | | Pause Time | 5 | |
| 13 | Drain 501 | 5 | Process # | 1 | 1 MIN |
| | | | Time | 1 | |

TABLE 5.05-continued

| SEWAGE | | | | | |
|---|---|---|---|---|---|
| Step | Action | Recipe Group | Detail | Variable | Time |
| CYCLE #4 - Rinse #1 | | | | | |
| 14 | Water In 203 | 2 | Process # | 3 | 1 FILL |
| | | | Temp | 200 | |
| | | | To Get | V V | |
| 15 | Rotation 402 | 4 | Process # | 2 | 10 MIN |
| | | | RPM | 19 | |
| | | | Run Time | 10 | |
| | | | Rotate Time | 30 | |
| | | | Pause Time | 5 | |
| 16 | Drain 501 | 5 | Process # | 1 | 1 MIN |
| | | | Time | 1 | |
| CYCLE #5 - Rinse #2 with Finishing | | | | | |
| 17 | Water In 203 | 2 | Process # | 3 | 1 FILL |
| | | | Temp | 20 | |
| | | | To Get | V V | |
| 18 | SOFTENER (Finishing Agent) 313 | 3 | Process # | 4 | 2 MIN |
| | | | Pump # | 5 | |
| | | | Volume | 340 | |
| | | | Flush Time | 20 | |
| 19 | Rotation 402 | 4 | Process # | 2 | 10 MIN |
| | | | RPM | 19 | |
| | | | Run Time | 10 | |
| | | | Rotate Time | 30 | |
| | | | Pause Time | | |
| 20 | Extract 603 | 6 | Process # | 3 | 15 MIN |
| | | | Extract Time | 15 | |
| | | | Extract | 19 | |
| | | | Drain RPM | | |
| | | | First Speed | | |
| | | | Second Speed | | |
| | | | Final Speed | V V | |

TOTAL TIME 114 MIN + 5 FILLS

TABLE 5.06

| LEATHERS LIGHT SOIL | | | | | |
|---|---|---|---|---|---|
| Step | Action | Recipe Group | Detail | Variable | Time |
| CYCLE #1 - Wash | | | | | |
| 1 | Water In 203 | 2 | Process # | 3 | 1 FILL |
| | | | Temp | 20 | |
| | | | To Gel | 148 | |
| 2 | CLASSIC STAGE 1 (TAK 1 Detergent) 301 | I | Process # | 1 | 2 MIN |
| | | | Pump # | 1 | |
| | | | Volume | 340 | |
| | | | Flush Time | 20 | |
| 3 | CLASSIC STAGE 2 (Penetrator Detergent) 306 | 3 | Process # | 6 | 2 MIN |
| | | | Pump # | 2 | |
| | | | Volume | 480 | |
| | | | Flush Time | 20 | |
| 4 | Rotation 403 | 4 | Process # | 3 | 15 MIN |
| | | | RPM | 14 | |
| | | | Run Time | 15 | |
| | | | Rotate Time | 30 | |
| | | | Pause Time | 5 | |
| 5 | Drain 502 | 5 | Process # | 2 | 2 MIN |
| | | | Time | 2 | |
| CYCLE #2 - Rinse with Stage 4 | | | | | |
| 6 | Water In 203 | 2 | Process # | 3 | 1 FILL |
| | | | Temp | 20 | |
| | | | To Get | 148 | |
| 7 | SOFTENER (Finishing Agent) 313 | 3 | Process # | 4 | 2 MIN |
| | | | Pump # | 5 | |
| | | | Volume | 340 | |
| | | | Flush Time | 20 | |

TABLE 5.06-continued

| LEATHERS LIGHT SOIL | | | | | |
|---|---|---|---|---|---|
| Step | Action | Recipe Group | Detail | Variable | Time |
| 8 | Rotation 405 | 4 | Process # | 5 | 10 MIN |
| | | | RPM | 14 | |
| | | | Run Time | 10 | |
| | | | Rotate Time | 30 | |
| | | | Pause Time | 5 | |
| 9 | Extract 602 | 6 | Process # | 2 | 10 MIN |
| | | | Extract Time | 10 | |
| | | | Extract Drain RPM | 19 | |
| | | | First Speed | 54 | |
| | | | Second Speed | 81 | |
| | | | Final Speed | 196 | |

TOTAL TIME 43 MIN + 2 FILLS

TABLE 5.07

| LEATHERS SEWAGE | | | | | |
|---|---|---|---|---|---|
| Step | Action | Recipe Group | Detail | Variable | Time |
| CYCLE #1 - Wash | | | | | |
| 1 | Water In 203 | 2 | Process # | 3 | 1 FILL |
| | | | Temp | 20 | |
| | | | To Get | 148 | |
| 2 | CLASSIC STAGE 1 (TAK 1 Detergent) 301 | 3 | Process # | 1 | 2 MIN |
| | | | Pump # | 1 | |
| | | | Volume | 340 | |
| | | | Flush Time | 20 | |
| 3 | CLASSIC STAGE 2 (Penetrator Detergent) 306 | 3 | Process # | 6 | 2 MIN |
| | | | Pump # | 2 | |
| | | | Volume | 480 | |
| | | | Flush Time | 20 | |
| 4 | Rotation 405 | 4 | Process # | 5 | 10 MIN |
| | | | RPM | 14 | |
| | | | Run Time | 10 | |
| | | | Rotate Time | 30 | |
| | | | Pause Time | 5 | |
| 5 | Drain 502 | 5 | Process # | 2 | 2 MIN |
| | | | Time | 2 | |
| CYCLE #2 - Sanitize | | | | | |
| 6 | Water In 203 | 2 | Process # | 3 | 1 FILL |
| | | | Temp | 20 | |
| | | | To Get | 148 | |
| 7 | CLASSIC STAGE 3 (Force Additive) 305 | 3 | Process # | 5 | 2 MIN |
| | | | Pump # | 3 | |
| | | | Volume | 390 | |
| | | | Flush Time | 20 | |
| 8 | Rotation 406 | 4 | Process # | 6 | 5 MIN |
| | | | RPM | 14 | |
| | | | Run Time | 5 | |
| | | | Rotate Time | 30 | |
| | | | Pause Time | 5 | |
| 9 | Drain 502 | 5 | Process # | 2 | 2 MIN |
| | | | Time | 2 | |
| CYCLE #3 - Rinse with Stage 4 | | | | | |
| 10 | Water In 203 | 2 | Process # | 3 | 1 FILL |
| | | | Temp | 20 | |
| | | | To Get | 148 | |
| 11 | SOFTENER (Finishing Agent) 313 | 3 | Process # | 4 | 2 MIN |
| | | | Pump # | 5 | |
| | | | Volume | 340 | |
| | | | Flush Time | 20 | |
| 12 | Rotation 406 | 4 | Process # | 6 | 5 MIN |
| | | | RPM | 14 | |
| | | | Run Time | 5 | |
| | | | Rotate Time | 30 | |
| | | | Pause Time | 5 | |

TABLE 5.07-continued

| LEATHERS SEWAGE | | | | | |
|---|---|---|---|---|---|
| Step | Action | Recipe Group | Detail | Variable | Time |
| 13 | Extract 602 | 6 | Process # | 2 | 10 MIN |
| | | | Extract Time | 10 | |
| | | | Extract Drain RPM | 19 | |
| | | | First Speed | 54 | |
| | | | Second Speed | 81 | |
| | | | Final Speed | 196 | |

TOTAL TIME 42 MIN + 3 FILLS

TABLE 5.08

| FIREFIGHTER THERMAL LINER MOISTURE BARRIER | | | | | |
|---|---|---|---|---|---|
| Step | Action | Recipe Group | Detail | Variable | Time |
| Cycle #1 - wash | | | | | |
| 1 | Water In 205 | 2 | Process # | 5 | 1 FILL |
| | | | Temp | 40 | |
| | | | To Get | 148 | |
| 2 | PPE Cleaner 310 | 3 | Process # | 10 | 2 MIN |
| | | | Pump # | 6 | |
| | | | Volume | 680 | |
| | | | Flush Time | 20 | |
| 3 | Rotation 405 | 4 | Process # | 5 | 10 MIN |
| | | | RPM | 14 | |
| | | | Run Time | 10 | |
| | | | Rotate Time | 30 | |
| | | | Pause Time | 5 | |
| 4 | Extract 604 | 6 | Process # | 4 | 6 MIN |
| | | | Extract Time | 6 | |
| | | | Extract Drain RPM | 19 | |
| | | | First Speed | 54 | |
| | | | Second Speed | 81 | |
| | | | Final Speed | 196 | |
| CYCLE #2 - Rinse #1 | | | | | |
| 5 | Water In 204 | 2 | Process # | 4 | 1 FILL |
| | | | Temp | 35 | |
| | | | To Get | 148 | |
| 6 | Rotation 405 | 4 | Process # | 5 | 10 MIN |
| | | | RPM | 14 | |
| | | | Run Time | 10 | |
| | | | Rotate Time | 30 | |
| | | | Pause Time | 5 | |
| 7 | Extract 604 | 6 | Process # | 4 | 6 MIN |
| | | | Extract Time | 6 | |
| | | | Extract Drain RPM | 19 | |
| | | | First Speed | 54 | |
| | | | Second Speed | 81 | |
| | | | Final Speed | 196 | |
| CYCLE #3 - Rinse #2 | | | | | |
| 8 | Water In 206 | 2 | Process # | 6 | 1 FILL |
| | | | Temp | 35 | |
| | | | To Get | 148 | |
| 9 | Rotation 406 | 4 | Process # | 6 | 5 MIN |
| | | | RPM | 14 | |
| | | | Run Time | 5 | |
| | | | Rotate Time | 30 | |
| | | | Pause Time | 5 | |
| 10 | Extract 605 | 6 | Process # | 5 | 25 MIN |
| | | | Extract Time | 25 | |
| | | | Extract Drain RPM | 19 | |
| | | | First Speed | 54 | |
| | | | Second Speed | 81 | |
| | | | Final Speed | 196 | |

TOTAL TIME 64 MIN +3 FILLS

TABLE 5.09

FIREFIGHTER THERMAL LINER
MOISTURE BARRIER W/PRE RINSE

| Step | Action | Recipe Group | Detail | Variable | Time |
|---|---|---|---|---|---|
| | | CYCLE #1 - Rinse #1 | | | |
| 1 | Water In 204 | 2 | Process # | 4 | 1 |
| | | | Temp | 30 | FILL |
| | | | To Get | 165 | |
| 2 | Rotation 406 | 4 | Process # | 6 | 5 |
| | | | RPM | 14 | MIN |
| | | | Run Time | 5 | |
| | | | Rotate Time | 30 | |
| | | | Pause Time | 5 | |
| 3 | Extract 604 | 6 | Process # | 4 | 6 |
| | | | Extract time | 6 | MIN |
| | | | Extract | 19 | |
| | | | Drain RPM | | |
| | | | 1st speed | 54 | |
| | | | 2nd speed | 81 | |
| | | | Final Speed | 196 | |
| | | CYCLE #2 - Rinse #2 | | | |
| 4 | Water In 204 | 2 | Process # | 4 | 1 |
| | | | Temp | 30 | FILL |
| | | | To Get | 165 | |
| 5 | Rotation 406 | 4 | Process # | 6 | 5 |
| | | | RPM | 14 | MIN |
| | | | Run Time | 5 | |
| | | | Rotate Time | 30 | |
| | | | Pause Time | 5 | |
| 6 | Extract 604 | 6 | Process # | 4 | 6 |
| | | | Extract Time | 6 | MIN |
| | | | Extract | 19 | |
| | | | Drain RPM | | |
| | | | First Speed | 54 | |
| | | | Second Speed | 81 | |
| | | | Final Speed | 196 | |
| | | CYCLE #3 - Wash | | | |
| 7 | Water In 205 | 2 | Process # | 5 | 1 |
| | | | Temp | 40 | FILL |
| | | | To Get | 148 | |
| 8 | PPE Cleaner 311 | 3 | Process # | 11 | 2 |
| | | | Pump # | 6 | MIN |
| | | | Volume | 960 | |
| | | | Flush Time | 20 | |
| 9 | Rotation 405 | 4 | Process # | 5 | 10 |
| | | | RPM | 10 | MIN |
| | | | Run Time | 10 | |
| | | | Rotate Time | 30 | |
| | | | Pause Time | 5 | |
| 10 | Extract 604 | 6 | Process # | 4 | 6 |
| | | | Extract Time | 6 | MIN |
| | | | Extract | 19 | |
| | | | Drain RPM | | |
| | | | First Speed | 54 | |
| | | | Second Speed | 81 | |
| | | | Final Speed | 196 | |
| | | CYCLE #4 - Rinse #3 | | | |
| 11 | Water In 204 | 2 | Process # | 4 | 1 |
| | | | Temp | 30 | FILL |
| | | | To Get | 165 | |
| 12 | Rotation 406 | 4 | Process # | 6 | 5 |
| | | | RPM | 14 | MIN |
| | | | Run Time | 5 | |
| | | | Rotate Time | 30 | |
| | | | Pause Time | 5 | |
| 13 | Extract 604 | 6 | Process # | 4 | 6 |
| | | | Extract Time | 6 | MIN |
| | | | Extract | 19 | |
| | | | Drain RPM | | |
| | | | First Speed | 54 | |
| | | | Second Speed | 81 | |
| | | | Final Speed | 196 | |

TABLE 5.09-continued

FIREFIGHTER THERMAL LINER
MOISTURE BARRIER W/PRE RINSE

| Step | Action | Recipe Group | Detail | Variable | Time |
|---|---|---|---|---|---|
| | | CYCLE #5 - Rinse #4 | | | |
| 14 | Water In 206 | 2 | Process # | 6 | 1 |
| | | | Temp | 30 | FILL |
| | | | To Get | 148 | |
| 15 | Rotation 406 | 4 | Process # | 6 | 5 |
| | | | RPM | 14 | MIN |
| | | | Run Time | 5 | |
| | | | Rotate Time | 30 | |
| | | | Pause Time | 5 | |
| 16 | Extract 605 | 6 | Process # | 5 | 25 |
| | | | Extract Time | 25 | MIN |
| | | | Extract | 19 | |
| | | | Drain RPM | | |
| | | | First Speed | 54 | |
| | | | Second Speed | 81 | |
| | | | Final Speed | 196 | |

TOTAL TIME 81 MIN + 5 FILLS

TABLE 5.10

FIREFIGHTER OUTER SHELL

| Step | Action | Recipe Group | Detail | Variable | Time |
|---|---|---|---|---|---|
| | | CYCLE #1 - Rinse #1 | | | |
| I | Water In 204 | 2 | Process # | 4 | 1 FILL |
| | | | Temp | 30 | |
| | | | To Get | 165 | |
| 2 | Rotation 411 | i | Process # | 11 | 5 MIN |
| | | | RPM | 22 | |
| | | | Run Time | 5 | |
| | | | Rotate Time | 30 | |
| | | | Pause Time | 5 | |
| 3 | Drain 502 | 5 | Process # | 2 | 2MIN |
| | | | Time | 2 | |
| | | CYCLE #2 - Wash | | | |
| 4 | Water In 205 | 2 | Process # | 5 | 1 FILL |
| | | | Temp | 40 | |
| | | | To Get | 148 | |
| 5 | PPE Cleaner 310 | 3 | Process # | 10 | 2 MIN |
| | | | Pump # | 6 | |
| | | | Volume | 680 | |
| | | | Flush Time | 20 | |
| 6 | Rotation 412 | 4 | Process # | 12 | 10 MIN |
| | | | RPM | 22 | |
| | | | Run Time | 10 | |
| | | | Rotate Time | 30 | |
| | | | Pause Time | 5 | |
| 7 | Extract 604 | 6 | Process # | 4 | 6 MIN |
| | | | Extract time | 6 | |
| | | | Extract | 12 | |
| | | | Drain RPM | | |
| | | | 1st speed | 54 | |
| | | | 2nd speed | 81 | |
| | | | Final Speed | 196 | |
| | | CYCLE #3 - Rinse #2 | | | |
| 8 | Water In 204 | 2 | Process # | 4 | 1 FILL |
| | | | Temp | 30 | |
| | | | To Get | 165 | |
| 9 | Rotation 411 | 4 | Process # | 11 | 5 MIN |
| | | | RPM | 22 | |
| | | | Run Time | 5 | |
| | | | Rotate Time | 30 | |
| | | | Pause Time | 5 | |
| 10 | Extract 604 | 6 | Process # | 4 | 6 MIN |
| | | | Extract Time | 6 | |
| | | | Extract | 19 | |
| | | | Drain RPM | | |

TABLE 5.10-continued

| FIREFIGHTER OUTER SHELL | | | | | |
|---|---|---|---|---|---|
| Step | Action | Recipe Group | Detail | Variable | Time |
| | | | First Speed | 54 | |
| | | | Second Speed | 81 | |
| | | | Final Speed | 196 | |
| | | CYCLE #4 - Rinse #3 | | | |
| 11 | Water In 206 | 2 | Process # | 6 | 1 FILL |
| | | | Temp | 30 | |
| | | | To Get | 148 | |
| 12 | Rotation 411 | 4 | Process # | 11 | 5 MIN |
| | | | RPM | 22 | |
| | | | Run Time | 5 | |
| | | | Rotate Time | 30 | |
| | | | Pause Time | 5 | |
| 11 | Extract 605 | 6 | Process # | 5 | 25 MIN |
| | | | Extract Time | 25 | |
| | | | Extract Drain RPM | 19 | |
| | | | First Speed | 54 | |
| | | | Second Speed | 81 | |
| | | | Final Speed | 196 | |

TOTAL TIME 66 MIN + 4 FILLS

TABLE 5.11

| FIREFIGHTER OUTERSHELL W/PRE RINSE | | | | | |
|---|---|---|---|---|---|
| Step | Action | Recipe Group | Detail | Variable | Time |
| | | CYCLE #1 - Rinse #1 | | | |
| 1 | Water In 202 | 2 | Process # | 2 | 1 FILL |
| | | | Temp | 30 | |
| | | | To Get | 165 | |
| 2 | Rotation 411 | 4 | Process # | 11 | 5 MIN |
| | | | RPM | 22 | |
| | | | Run Time | 5 | |
| | | | Rotate Time | 30 | |
| | | | Pause Time | 5 | |
| 3 | Extract 604 | 6 | Process # | 4 | 6 MIN |
| | | | Extract time | 6 | |
| | | | Extract Drain RPM | 19 | |
| | | | 1st speed | 54 | |
| | | | 2nd speed | 81 | |
| | | | Final Speed | 196 | |
| | | CYCLE #2 - Rinse #2 | | | |
| 4 | Water In 204 | 2 | Process # | 4 | 1 FILL |
| | | | Ieinp | 30 | |
| | | | To Get | 165 | |
| 5 | Rotation 411 | 4 | Process # | Jl | |
| | | | RPM | 22 | |
| | | | Run Time | 5 | 5 MIN |
| | | | Rotate Time | 30 | |
| | | | Pause Time | 5 | |
| 6 | Extract 604 | 6 | Process # | 4 | 6 MIN |
| | | | Extract Time | 6 | |
| | | | Extract Drain RPM | 19 | |
| | | | First Speed | 54 | |
| | | | Second Speed | 81 | |
| | | | Final Speed | 196 | |
| | | CYCLE #3 - Wash | | | |
| 7 | Water In 205 | 2 | Process # | 5 | 1 FILL |
| | | | Temp | 40 | |
| | | | To Get | 148 | |
| 8 | PPE Cleaner 312 | | Process # | 12 | 2 MIN |
| | | | Pump # | 6 | |
| | | | Time | 990 | |
| | | | Flush Time | 20 | |

TABLE 5.11-continued

| FIREFIGHTER OUTERSHELL W/PRE RINSE | | | | | |
|---|---|---|---|---|---|
| Step | Action | Recipe Group | Detail | Variable | Time |
| 9 | Rotation 412 | 4 | Process # | 12 | 10 MIN |
| | | | RPM | 22 | |
| | | | Run Time | 10 | |
| | | | Rotate Time | 30 | |
| | | | Pause Time | 5 | |
| 10 | Extract 604 | 6 | Process # | 4 | 6 MIN |
| | | | Extract Time | 6 | |
| | | | Extract Drain RPM | 19 | |
| | | | First Speed | 54 | |
| | | | Second Speed | 81 | |
| | | | Final Speed | 196 | |
| | | CYCLE #4 - Rinse #3 | | | |
| U | Water In 204 | 2 | Process # | 4 | 1 FILL |
| | | | Temp | 30 | |
| | | | To Get | 165 | |
| 12 | Rotation 411 | 4 | Process # | 11 | 5 MIN |
| | | | RPM | 22 | |
| | | | Run Time | 5 | |
| | | | Rotate Time | 30 | |
| | | | Pause Time | 5 | |
| 13 | Extract 604 | 6 | Process # | 4 | 6 MIN |
| | | | Extract Time | 6 | |
| | | | Extract Drain RPM | 19 | |
| | | | First Speed | 54 | |
| | | | Second Speed | 81 | |
| | | | Final Speed | 196 | |
| | | CYCLE #5 - Rinse #4 | | | |
| 14 | Water In 206 | 2 | Process # | 6 30 148 | 1 FILL |
| | | | Temp | | |
| | | | To Get | | |
| 15 | Rotation 411 | 4 | Process # | 11 | 5 MIN |
| | | | RPM | 22 | |
| | | | Run Time | 5 | |
| | | | Rotate Time | 30 | |
| | | | Pause Time | 5 | |
| 16 | Extract 605 | 0 | Process # | 5 | 25 MIN |
| | | | Extract Time | 25 | |
| | | | Extract Drain RPM | 19 | |
| | | | First Speed | 54 | |
| | | | Second Speed | 81 | |
| | | | Final Speed | 196 | |

TOTAL TIME 81 MIN + 5 FILLS

TABLE 5.12

| FIREFIGHTER HELMET | | | | | |
|---|---|---|---|---|---|
| Step | Action | Recipe Group | Detail | Variable | Time |
| | | CYCLE #1 - Rinse #1 | | | |
| 1 | Water In 204 | 2 | Process # | 4 | 1 FILL |
| | | | Temp | 30 | |
| | | | To Gel | 165 | |
| 2 | Rotation 411 | 4 | Process # | 11 | 5 MIN |
| | | | RPM | 22 | |
| | | | Run Time | 3 | |
| | | | Rotate Time | 30 | |
| | | | Pause Time | 5 | |
| 3 | Drain 502 | 5 | Process # | 2 | 2 MIN |
| | | | Time | 2 | |
| | | CYCLE #2 - Wash | | | |
| 4 | Water In 205 | 2 | Process # | 5 | 1 FILL |
| | | | Temp | 40 | |
| | | | To Get | 148 | |

TABLE 5.12-continued

| FIREFIGHTER HELMET | | | | | |
|---|---|---|---|---|---|
| Step | Action | Recipe Group | Detail | Variable | Time |
| 5 | PPE Cleaner Hi | 3 | Process # | LL | 2 |
| | | | Pump # | | MIN |
| | | | Volume | ;60 | |
| | | | Flush Time | 20 | |
| 6 | Rotation 412 | 4 | Process # | 12 | 10 |
| | | | RPM | 22 | MIN |
| | | | Run Time | 10 | |
| | | | Rotate Time | 30 | |
| | | | Pause Time | 5 | |
| 7 | Extract 604 | 6 | Process # | 4 | 6 |
| | | | Extract Time | 6 | MIN |
| | | | Extract Drain RPM | 19 | |
| | | | First Speed | 54 | |
| | | | Second Speed | 81 | |
| | | | Final Speed | 596 | |
| CYCLE #3 - Rinse #2 | | | | | |
| 8 | Water In 204 | 2 | Process # | 4 | 1 |
| | | | Temp | 30 | FILL |
| | | | To Get | 165 | |
| 9 | Rotation 411 | 4 | Process # | 11 | 5 |
| | | | RPM | 22 | MIN |
| | | | Run Time | 5 | |
| | | | Rotate Time | 30 | |
| | | | Pause Time | 5 | |
| 10 | Drain 502 | 5 | Process # | 2 | |
| | | | Time | 2 | MIN |
| CYCLE #4 - Rinse #3 | | | | | |
| 11 | Water In 204 | 2 | Process # | 4 | 1 |
| | | | Temp | 30 | FILL |
| | | | lo (ici | 165 | |
| 12 | Rotation 411 | 4 | Process # | 11 | 5 |
| | | | RPM | 22 | MIN |
| | | | Run Time | 5 | |
| | | | Rotate Time | 30 | |
| | | | Pause Time | 5 | |
| 13 | Drain 502 | 5 | Process # | 2 | 2 |
| | | | Time | 2 | MIN |
| CYCLE #5 - Rinse #4 | | | | | |
| 14 | Water In 204 | 2 | Process # | 4 | 1 |
| | | | Temp | 30 | FILL |
| | | | To Gel | 165 | |
| 15 | Rotation 411 | 4 | Process # | 11 | 5 |
| | | | RPM | 22 | MIN |
| | | | Run Time | 5 | |
| | | | Rolale Time | 30 | |
| | | | Pause Time | 5 | |
| 16 | Extract 605 | 6 | Process # | 5 | 25 |
| | | | Extract Time | 25 | MIN |
| | | | Extract Drain RPM | 19 | |
| | | | First Speed | 54 | |
| | | | Second Speed | 81 | |
| | | | Final Speed | 196 | |

TABLE 5.13

| FIREFIGHTER HELMET W/PRE RINSE | | | | | |
|---|---|---|---|---|---|
| Step | Action | Recipe Group | Detail | Variable | Time |
| CYCLE #1 - Rinse #1 | | | | | |
| 1 | Water In 204 | 2 | Process # | 4 | 1 FILL |
| | | | Temp | 30 | |
| | | | To Get | 165 | |
| 2 | Rotation 411 | 4 | Process # | 11 | 5 MIN |
| | | | RPM | 22 | |
| | | | Run Time | 5 | |

TABLE 5.13-continued

| FIREFIGHTER HELMET W/PRE RINSE | | | | | |
|---|---|---|---|---|---|
| Step | Action | Recipe Group | Detail | Variable | Time |
| | | | Rotate Time | 30 | |
| | | | Pause Time | 5 | |
| 3 | Drain 502 | 5 | Process # | 2 | 2 MIN |
| | | | Time | 2 | |
| CYCLE #2 - Rinse #2 | | | | | |
| 4 | Water In 204 | 2 | Process # | 4 | 1 FILL |
| | | | Temp | 30 | |
| | | | To Get | 165 | |
| 5 | Rotation 411 | 4 | Process # | 11 | 5 MIN |
| | | | RPM | 22 | |
| | | | Run Time | 5 | |
| | | | Rotate Time | 30 | |
| | | | Pause Time | 5 | |
| 6 | Drain 502 | 5 | Process # | 2 | 2 MIN |
| | | | Time | 2 | |
| CYCLE #3 - Wash | | | | | |
| 7 | Water In 205 | 2 | Process # | 5 | 1 FILL |
| | | | Temp | 40 | |
| | | | To Get | 148 | |
| 8 | PPE Cleaner 311 | 3 | Process # | 11 | 2 MIN |
| | | | Pump # | 6 | |
| | | | Volume | 960 | |
| | | | Flush Time | 20 | |
| 9 | Rotation 412 | 4 | Process # | 12 | 10 MIN |
| | | | RPM | 22 | |
| | | | Run Time | 10 | |
| | | | Rotate Time | 30 | |
| | | | Pause Time | 5 | |
| 10 | Extract 604 | 5 | Process # | 4 | 6 MIN |
| | | | Extract Time | 6 | |
| | | | Extract Drain RPM | 19 | |
| | | | First Speed | 54 | |
| | | | Second Speed | 81 | |
| | | | Final Speed | 196 | |
| CYCLE #4 - Rinse #3 | | | | | |
| 11 | Water In 204 | 2 | Process # | 4 | 1 FILL |
| | | | Temp | 30 | |
| | | | To Get | 165 | |
| 12 | Rotation 411 | 4 | Process # | 11 | 5 MIN |
| | | | RPM | 22 | |
| | | | Run Time | 5 | |
| | | | Rotate Time | 30 | |
| | | | Pause Time | 5 | |
| 13 | Drain 502 | 5 | Process # | 2 | 2 MIN |
| | | | Time | 2 | |
| CYCLE #5 - Rinse #4 | | | | | |
| 14 | Water In 204 | 2 | Process # | 4 | 1 FILL |
| | | | Temp | 30 | |
| | | | To Get | 165 | |
| 15 | Rotation 411 | 4 | Process # | 11 | 5 MIN |
| | | | RPM | 22 | |
| | | | Run Time | 5 | |
| | | | Rotate Time | 30 | |
| | | | Pause Time | 5 | |
| 16 | Drain 502 | 5 | Process # | 2 | 2 MIN |
| | | | Time | 2 | |
| CYCLE #6 - Rinse #5 | | | | | |
| 17 | Water In 204 | 2 | Process # | 4 | 1 FILL |
| | | | Temp | 30 | |
| | | | To Get | 165 | |
| 18 | Rotation 411 | 4 | Process # | 11 | 5 MIN |
| | | | RPM | 22 | |
| | | | Run Time | 5 | |
| | | | Rotate Time | 30 | |
| | | | Pause Time | 5 | |

TABLE 5.13-continued

| FIREFIGHTER HELMET W/PRE RINSE | | | | | |
|---|---|---|---|---|---|
| Step | Action | Recipe Group | Detail | Variable | Time |
| 19 | Extract 605 | 6 | Process # | 5 | 25 MIN |
| | | | Extract Time | 25 | |
| | | | Extract Drain RPM | 19 | |
| | | | First Speed | 54 | |
| | | | Second Speed | 81 | |
| | | | Final Speed | 196 | |

TOTAL TIME 76 MIN + 6 FILLS

TABLE 5.14

| MACHINE FLUSH | | | | | |
|---|---|---|---|---|---|
| Step | Action | Recipe Group | Detail | Variable | Time |
| | | CYCLE #1 - Rinse #1 | | | |
| 1 | Water In | 2 | Process # | 3 | 1 FILL |
| | | | Temp | 20 | |
| | | | To Get | 148 | |
| 2 | CLASSIC STAGE 3 (Force Additive) 305 | 3 | Process # | 5 | 2 MIN |
| | | | Pump # | 3 | |
| | | | Volume | V V | |
| | | | Plush Time | 10 | |
| 3 | Rotation 412 | 4 | Process # | 12 | 10 MIN |
| | | | RPM | 22 | |
| | | | Run Time | 10 | |
| | | | Rotate Time | 30 | |
| | | | Pause Time | 5 | |
| 4 | Drain 502 | 5 | Process # | 2 | 2 MIN |
| | | | Time | 2 | |

TOTAL TIME 14 MIN + 1 FILL

TABLE 6

| DETERGENTS | |
|---|---|
| Name | Description |
| Stage 1 | An enzyme based detergent produced by non-pathogenic bacteria designed to breakdown protein oils such as sweat, blood, proteins, and fungi. It also destroys the food source of pathogenic bacteria such as staphylococcus. |
| Stage 2 | A blend of detergents, detergent builders, water-soluble solvents, and optical enhancing brighteners. The detergent builders and buffered alkalinity maintain an optimum pH of 9.5. |
| Stage 3 | A built-in sour plus a sanitizer that contains peroxyacetic acid and other oxygen-based bleaching agents. Force additive is proven effective in killing bacterial including MRSA staphylococcus aureus, viruses, and mold spores. |
| PPE | PPE Cleaner is a detergent based on naturally derived dynamic surfactants and multifunctional enzymatic action instead of traditional synthetic chemistry. It cleans PPE materials by breaking down soils, contaminants and odors. This product is specifically formulated for cleaning and decontamination of Personal Protective Equipment. This product is used in place of Stages 1 & 2. |

Thus as will be appreciated by those skilled in the art, the present system is characterized by high levels of control over the washing machinery, the system architecture, data flow, data polling, reporting, overview, administration, and feed-back and over the wash processor controlled recipes so that operator input is minimized to thereby optimize the consistent restoration of soft items to a food-grade-safe level of cleanliness.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A remote monitoring system comprising:

a volume of consumables independently pre-certified to clean and restore an item to a pre-determined certification standard of cleanliness;

at least one washing machine for washing wash items;

at least one container configured to hold the volume of the consumables, the at least one container being removably couplable to the at least one washing machine and configured to provide a portion of the volume of the consumables to the washing machine during a washing cycle;

a wash processor comprising a tracking mechanism configured to track wash environment data, wherein the wash processor is adapted to communicate over the internet;

at least one container identifier associated with the at least one container for identifying a characteristic of the consumables;

an administrator processor, remote from said at least one washing machine, adapted to communicate over the internet with each said wash processor and to receive data from each said wash processor on a repeating, short-time interval, the administrator processor configured to, for each of the at least one washing machine, track the portion of the volume of the consumables used by the washing machine, track the level of the volume of the consumables in the at least one container, and when the stored volume of the consumables decreases below a pre-determined refill threshold in the at least one container automatically begin resupply procedures to provide additional consumables to the system.

2. The system of claim 1 wherein the at least one washing machine comprises a plurality of adjustable washing compartments in a rotary drum rotatably mounted in a sealed wash housing in each of the washing machines.

3. The system of claim 2 wherein the certification standard is defined as a measured RLU reading of substantially ten RLUs.

4. The system of claim 3 wherein the system is configured to actuate a water dispensing system to fill the at least one washing machine with a predetermined volume of water;

actuate a motor to rotate the drum; and a consumables dispensing system to dispense a predetermined volume of the volume of consumables into the at least one washing machine and mix with the water to form a wash fluid while the drum is rotating; and remove the wash fluid from the at least one washing machine via variable speed centrifugal rotation of the rotary drum.

5. The system of claim 4 wherein the administrator processor uses the information from the wash processor for each said washing machine to track the consumption of the consumables by each said washing machine, to track the available volume of the consumables available at each said washing machine, and to compare the consumption of the consumables to the available volume of the consumables at each said washing machine, and to determine therefrom status information including an anticipated resupply request for consumables from an operator of each said washing machine, and upon failure to receive said re-supply request for one or more of each said washing machines to execute and deliver to a corresponding said one or more washing machines a remote warning, and/or shut-down of the corresponding said one or more washing machines.

6. The system of claim 5 wherein the information provided to said administrator processor also includes tracking the re-supply of the re-supply consumables to determine an estimated arrival of the re-supply consumables at each said washing machine.

7. The system of claim 5 wherein the information provided to said administrator processor includes information updating the available volume of the consumables at each said washing machine, and comparing a rate of consumption of the consumables to the available volume of consumables at each said washing machine to determine an estimation of when the consumables will be substantially completely consumed by each said washing machine, and to thereby determine said anticipated re-supply request.

8. The system of claim 2, wherein each washing compartment comprises:

a rigid frame comprising a trapezoidal prism shape, and a permeable insert configured to fit within the rigid frame.

9. The system of claim 8, further comprising a system for detecting a characteristic of the wash item, determining a wash protocol for the at least one washing machine based on the characteristic of the wash item, and actuating the at least one washing machine based on the characteristic of the wash item.

10. The system of claim 9 wherein said wash processor substantially eliminates said operator control of said wash variables for said wash items.

11. A method of using the system of claim 1 for the remote monitoring of cleanliness to a pre-certified standard being achieved by washing machines, the method including:

(a) providing the system of claim 1, (b) providing pre-certified recipes and pre-certified consumables that have been independently pre-certified by a third party certifier in the at least one washing machine, and (c) employing the pre-certified recipes and the pre-certified consumables so as to clean and restore the wash items to a predetermined certification standard of cleanliness approved by a provider of insurance over the wash items against damage to the wash items by reason of at least one of the group of spoilants.

12. The method of claim 11 wherein the certification standard of cleanliness is food-grade-safe.

13. The method of claim 12 wherein the certification standard is defined as a measured RLU reading of substantially ten RLUs.

14. The method of claim 13 further comprising the steps of actuating a water dispensing system to fill the at least one washing machine with a predetermined volume of water;

actuating a motor to rotate the drum; and a consumables dispensing system to dispense a predetermined volume of the volume of consumables into the at least one washing machine and mix with the water to form a wash fluid while the drum is rotating; and removing the wash fluid from the at least one washing machine, via variable speed centrifugal rotation of the rotary drum.

15. The method of claim 14 wherein the administrator processor uses the information from the wash processor for each said washing machine to track the consumption of the consumables by each said washing machine, to track the available volume of the consumables available at each said washing machine, and to compare the consumption of the consumables to the available volume of the consumables at each said washing machine, and or determine therefrom status information including an anticipated resupply request for consumables from an operator of each said washing machine, and upon failure to receive said re-supply request for one or more of each said washing machine to execute and deliver to a corresponding said one or more washing machines a remote warning, and/or shut-down of the corresponding said one or more washing machines.

16. The method of claim 15 wherein the information provided to said administrator processor also includes tracking the re-supply of the re-supply consumables to determine an estimated arrival of the re-supply consumables at each said washing machine.

17. The method of claim 15 wherein the information provided to said administrator processor includes information updating the available volume of the consumables at each said washing machine, and comparing a rate of consumption of the consumables to the available volume of consumables at each said washing machine to determine an estimation of when the consumables will be substantially completely consumed by each said washing machine, and to thereby determine said anticipated re-supply request.

18. The system of claim 8 wherein the permeable insert comprises a rigid container comprising a trapezoidal prism shape;

a permeable bag; or a combination thereof.

19. The method of claim 11 further comprising detecting a characteristic of the wash item;

determining a wash protocol for the at least one washing machine based on the characteristic of the wash item; and actuating the at least one washing machine based on the characteristic of the wash item.

20. The system of claim 1 wherein the wash environment data comprises data associated with water, the at least one container, the volume of consumables, the portion of the volume of the consumables used by the washing machine, and the level of the volume of the consumables held in the at least one container.

* * * * *